US011545758B2

(12) United States Patent
Koul et al.

(10) Patent No.: US 11,545,758 B2
(45) Date of Patent: Jan. 3, 2023

(54) PLANAR MULTIBAND FREQUENCY SELECTIVE SURFACES WITH STABLE FILTER RESPONSE

(71) Applicant: Synergy Microwave Corporation, Paterson, NJ (US)

(72) Inventors: Shiban K. Koul, Delhi (IN); Ajay Kumar Poddar, Elmwood Park, NJ (US); Sukomal Dey, Palakkad District (IN); Ulrich L. Rohde, Upper Saddle River, NJ (US)

(73) Assignee: Synergy Microwave Corporation, Paterson, NJ (US)

( * ) Notice: Subject to any disclaimer, the term of this patent is extended or adjusted under 35 U.S.C. 154(b) by 0 days.

(21) Appl. No.: 17/197,612

(22) Filed: Mar. 10, 2021

(65) Prior Publication Data

US 2022/0294120 A1 Sep. 15, 2022

(51) Int. Cl.

| | |
|---|---|
| ***H01Q 15/00*** | (2006.01) |
| ***H01Q 15/02*** | (2006.01) |
| ***H01Q 15/14*** | (2006.01) |
| *H01Q 19/08* | (2006.01) |

(52) U.S. Cl.
CPC ..... *H01Q 15/0026* (2013.01); *H01Q 15/14* (2013.01); *H01Q 19/08* (2013.01)

(58) Field of Classification Search
CPC .... H01Q 15/00; H01Q 15/0026; H01Q 15/14; H01Q 1/38; H01Q 19/08; H01Q 15/02; H01Q 15/24
See application file for complete search history.

(56) References Cited

U.S. PATENT DOCUMENTS

| | | | | |
|---|---|---|---|---|
| 5,140,338 | A * | 8/1992 | Schmier | H01Q 1/42 343/789 |
| 5,208,603 | A * | 5/1993 | Yee | H01Q 15/0026 343/872 |
| 5,949,387 | A | 9/1999 | Wu et al. | |
| 6,147,572 | A | 11/2000 | Kaminski et al. | |
| 6,208,316 | B1 | 3/2001 | Cahill | |
| 6,218,978 | B1 | 4/2001 | Simpkin et al. | |
| 6,670,932 | B1 | 12/2003 | Diaz et al. | |
| 6,822,622 | B2 * | 11/2004 | Crawford | H01Q 3/44 343/756 |

(Continued)

OTHER PUBLICATIONS

B. A. Munk, Frequency selective surfaces: theory and design, 1st ed. New York, NY, USA: Wiley, Apr. 2000, pp. 1-410.

(Continued)

*Primary Examiner* — Tho G Phan
(74) *Attorney, Agent, or Firm* — Lerner, David, Littenberg, Krumholz & Mentlik, LLP

(57) ABSTRACT

A frequency selective surface (FSS) having periodicity between one eighth and one quarter of an operational wavelength of the FSS and a low profile. The FSS has multiple pattern elements which are used to produce multiple transmission poles, and in some embodiments multiple transmission zeros. The transmission poles and transmission zeros are in the Ka and Ku bands, making the FSS applicable to 5G application. The transmission poles and transmission zeros also have high angular stability an oblique incident angle as high as 60°, as well as polarization insensitivity.

32 Claims, 31 Drawing Sheets

(56) References Cited

U.S. PATENT DOCUMENTS

| | | | | |
|---|---|---|---|---|
| 6,870,511 | B2 * | 3/2005 | Lynch | H01Q 15/0026 343/756 |
| 6,952,190 | B2 | 10/2005 | Lynch et al. | |
| 7,071,889 | B2 | 7/2006 | McKinzie, III et al. | |
| 7,151,506 | B2 * | 12/2006 | Knowles | H01Q 15/002 343/909 |
| 7,173,565 | B2 | 2/2007 | Sievenpiper | |
| 7,190,315 | B2 | 3/2007 | Waltho | |
| 7,420,524 | B2 * | 9/2008 | Werner | H01Q 15/002 343/909 |
| 7,639,206 | B2 | 12/2009 | Behdad | |
| 8,098,213 | B2 * | 1/2012 | Kim | H01P 1/20381 343/909 |
| 8,339,330 | B2 * | 12/2012 | Yun | H01Q 15/0013 343/912 |
| 8,633,866 | B2 | 1/2014 | Sarabandi et al. | |
| 8,842,056 | B2 | 9/2014 | Batchelor et al. | |

OTHER PUBLICATIONS

D. Li et al., "A low-profile broadband bandpass frequency selective surface with two rapid band edges for 5G near-field applications," IEEE Trans Electromagn. Compat, vol. 59, No. 2, pp. 670-676, Apr. 2017.

H. L. Liu, K. L. Ford and R. J. Langley, "Design methodology for a miniaturized frequency selective surface using lumped reactive components," IEEE Trans. Antennas Propag., vol. 57, No. 9, pp. 2732-2738, Sep. 2009.

K. Sarabandi and N. Behdad, "A frequency selective surface with miniaturized elements," IEEE Trans. Antennas Propag., vol. 55, No. 5, pp. 1239-1245, May 2007.

M. Hussein, J. Zhou, Y. Huang and B. Al-Juboori, "A low-profile miniaturized secondorder bandpass frequency selective surface," IEEE Antennas Wireless Propag. Lett., vol. 16, pp. 2791-2794, Aug. 2017.

M. Yan et al., "A miniaturized dual-band FSS with second-order response and large band separation," IEEE Antennas Wireless Propag. Lett., vol. 14, pp. 1602-1605, Mar. 2015.

M. Yan et al., "A miniaturized dual-band FSS with stable resonance frequencies of 2.4 GHz/5 GHz for WLAN applications," IEEE Antennas Wireless Propag. Lett., vol. 13, pp. 895-898, Apr. 2014.

M. Yan et al., "A novel miniaturized frequency selective surface with stable resonance," IEEE Antennas and Wireless Propagation Letters, vol. 13, pp. 639-641, Mar. 2014.

N. Jawad and L. Markley, "A single-layer frequency selective surface with dual wideband band-stop response," IEEE Antennas Wireless Propag. Lett., vol. 19, No. 6, pp. 916-920, Jun. 2020.

N. Liu, X. Sheng, C. Zhang, J. Fan and D. Guo, "A Miniaturized Triband Frequency Selective Surface Based on Convoluted Design," in IEEE Antennas and Wireless Propagation Letters, vol. 16, pp. 2384-2387, Jun. 2017.

P. Zhao, Z. Zong, W. Wu and D. Fang, "A convoluted structure for miniaturized frequency selective surface and its equivalent circuit for optimization design," IEEE Trans Antennas Propag., vol. 64, No. 7, pp. 2963-2970, Jul. 2016.

S. Çimen, "Novel closely spaced planar dual-band frequency-selective surface," IET Microw. Antenna Propag., vol. 7, No. 11, pp. 894-899, Aug. 2013.

S. Ghosh and K. V. Srivastava, "An angularly stable dual-band FSS with closely spaced resonances using miniaturized unit cell," IEEE Microw. Wireless Compon. Lett., vol. 27, No. 3, pp. 218-220, Mar. 2017.

S. M. A. Momeni Hasan Abadi and N. Behdad, "Inductively-coupled miniaturizedelement frequency selective surfaces with narrowband, high-order bandpass responses," IEEE Trans. Antennas Propag., vol. 63, No. 11, pp. 4766-4774, Nov. 2015.

W. Wu, X. Liu, K. Cui, Y. Ma and Y. Yuan, "An ultrathin and polarization-insensitive frequency selective surface at Ka-band," IEEE Antennas Wireless Propag. Lett., vol. 17, No. 1, pp. 74-77, Jan. 2018.

X. Sheng, J. Fan, N. Liu and C. Zhang, "A miniaturized dual-band FSS with controllable frequency resonances," IEEE Microw. Wireless Compon. Lett., vol. 27, No. 10, pp. 915-917, Oct. 2017.

X. Song, Z. Yan, T. Zhang, C. Yang and R. Lian, "Triband frequency-selective surface as subreflector in Ku-, K-, and Ka-bands," IEEE Antennas Wireless Propag. Lett., vol. 15, pp. 1869-1872, Mar. 2016.

Y. Li, P. Ren and Z. Xiang, "A dual-passband frequency selective surface for 5G communication," IEEE Antennas Wireless Propag. Lett., vol. 18, No. 12, pp. 2597-2601, Dec. 2019.

Y. Ma, W. Wu, Y. Yuan, X. Zhang and N. Yuan, "A convoluted structure for miniaturized dual-bandstop frequency selective surface," IEEE Antennas Wireless Propag. Lett., vol. 18, No. 2, pp. 328-332, Feb. 2019.

* cited by examiner

600

1900

2200

2500

PLANAR MULTIBAND FREQUENCY SELECTIVE SURFACES WITH STABLE FILTER RESPONSE

TECHNICAL FIELD

The present disclosure relates to artificially engineered planar periodic 2D structures for spatial filtering of incident electromagnetic waves.

BACKGROUND

Frequency Selective Surfaces (FSS), also referred to as periodic surfaces, are a repeating pattern of features, such as a metallic patches or apertures, formed on a surface material such as a metal screen. FSS typically exhibits resonant properties that make it suitable for bandstop and bandpass applications. FSS dimensions are typically measured according to an operational wavelength $\lambda_0$ that corresponds to a center frequency of a first transmission band that is stopped or passed by the FSS.

Conventional FSS unit cells are about $\lambda_2/2$ in size and only a few number of elements can be arranged within a limited area. Additionally, conventional first-order FSS has relatively poor roll-off at the lower and higher sidebands of the frequency band. One known way to sharpen the roll-off is to place first order elements in cascade with a $\lambda_2/4$ spacing in between in order to invert the impedance of first order FSS. However, the cascaded elements increases the total profile height of the FSS. Thus conventional FSS is limited to being a relatively large size in all dimensions.

Another drawback of conventional FSS are that they are designed with a single resonance, which makes them unsuitable for multifunctional applications requiring multiple resonance spatial filters.

SUMMARY

The present disclosure provides an FSS having periodicity between one eighth and one quarter of an operational wavelength of the FSS and a low profile. The FSS has multiple pattern elements which are used to produce multiple transmission poles, and in some embodiments multiple transmission zeros. The transmission poles and transmission zeros are in the Ka and Ku bands, making the FSS applicable to 5G applications. The transmission poles and transmission zeros also have high angular stability an oblique incident angle as high as 60°, as well as polarization insensitivity One aspect of the present disclosure is directed to a frequency selective surface (FSS) including: a plurality of unit cells arranged in an array, wherein each unit cell includes: a first dielectric substrate; a first metal layer formed on a top surface of the at least one dielectric substrate, wherein the first metal layer includes: a first pattern element positioned at a center of the unit cell and configured to produce a first transmission pole at a first frequency; and a second pattern element positioned around a border of the unit cell and configured to produce a second transmission pole at a second frequency different from the first frequency, wherein the second pattern elements of the plurality of unit cells collectively form a grid pattern, wherein the first pattern element is further configured to produce a transmission zero between the first frequency and the second frequency.

In some examples, the first pattern element may be a modified Jerusalem cross, and the modified Jerusalem cross may exhibit a capacitance that is greater than a capacitance of a standard Jerusalem cross.

In some examples, the modified Jerusalem cross may include a cross potent and a numeral 7 attached to a midpoint of each free end of the cross potent.

In some examples, the modified Jerusalem cross may include a first ring element including breaks at each corner of the first ring element, a cross element formed inside the first ring element. a second ring element formed outside of and concentric to the first ring element, and including breaks at each corner and at a midpoint of each side of the second ring element, and a plurality of connecting elements, each connecting element diagonally connecting corresponding broken corners of the first and second ring elements.

In some examples, the first pattern element may have 90° rotational symmetry.

In some examples, a center frequency of the transmission zero may shift less than 0.3% for electromagnetic waves at incident angles between 0-60°.

In some examples, respective center frequencies of the transmission poles may shift about 2% or less for TE mode electromagnetic waves at incident angles between 0-60°, and about 3% or less for TM mode electromagnetic waves at incident angles between 0-60°.

In some examples, the first frequency may be an uplink frequency within the Ku band, the second frequency may be an uplink frequency within the Ka band, and the transmission zero may be within a down-link frequency range for Ka band.

In some examples, a first passband around the first transmission pole may have a fractional bandwidth of about 8% for which return loss is less than −10 dB, a second passband around the second transmission pole may have a fractional bandwidth of about 11% for which return loss is less than −10 dB, and a stopband around the transmission zero may have a fractional bandwidth of about 12% for which insertion loss is less than −15 dB.

In some examples, each unit cell may have a length and width between one eighth and one quarter of an operational wavelength of the FSS and a height between one fiftieth and one twentieth of the operational wavelength.

In some examples, the plurality of unit cells may be arranged in a 20×20 array.

Another aspect of the present disclosure is directed to a frequency selective surface (FSS) comprising: a plurality of unit cells arranged in an array, wherein each unit cell includes: a bottom metal layer; a first dielectric substrate formed on a top surface of the bottom metal layer; a middle metal layer formed on a top surface of the first dielectric substrate; a second dielectric substrate formed on a top surface of the middle metal layer; and a top metal layer formed on a top surface of the second dielectric substrate, wherein each of the bottom and top metal layers include a first pattern element positioned at a center of the unit cell; and a second pattern element positioned around a border of the unit cell, and wherein the middle metal layer includes a third pattern element, wherein the third pattern elements of the plurality of unit cells collectively form a grid pattern.

In some examples, the bottom metal layer and first dielectric substrate may form a first filter element configured to produce a first-order filter response, the second dielectric substrate and top metal layer may form a second filter element configured to produce the first-order filter response, and the first filter element, the middle metal layer and the second filter element collectively may form a third filter element configured to produce a second-order filter response.

In some examples, the first-order filter response may produce a stopband having insertion loss of less than −15 dB over a fractional bandwidth of between 15-20% and a passband having return loss of less than −10 dB over a fractional bandwidth of between 10-15%.

In some examples, the second-order filter response may produce a stopband having insertion loss of less than −15 dB over a fractional bandwidth of between 20-25% and a passband having return loss of less than −10 dB over a fractional bandwidth of between 20-25%.

In some examples, the stopband may cover at least a frequency range between 25-30 GHz, and the passband may cover at least a frequency range between 19-22 GHz.

In some examples, the second-order filter response may produce two transmission poles within the passband, and two transmission zeros within the stopband.

In some examples, the passband may cover a down-link frequency range within Ka band, and the stopband may cover an uplink frequency range within the Ka band.

In some examples, the first pattern element may be a looped cross, and the second pattern element may be a plurality of spiral resonators positioned in respective quadrants of the unit cell.

In some examples, the looped cross may have a predetermined length, and the predetermined length of the looped cross may be configured to control a center frequency of a transmission pole of the FSS independently of a center frequency of a transmission zero of the FSS.

In some examples, the looped cross may be configured such that inclusion of the looped cross on each of each of the bottom and top metal layers results in an increase to a stopband bandwidth of the FSS.

In some examples, each of the first pattern element and the second pattern element may have 90° rotational symmetry.

In some examples, resonant frequency shifts of the FSS may be less than 3% for TE mode electromagnetic waves at incident angles between 0-60°, and less than 2% for TM mode electromagnetic waves at incident angles between 0-60°.

In some examples, each unit cell may have a length and width between one eighth and one quarter of an operational wavelength of the FSS and a height between one twentieth and one tenth of the operational wavelength.

In some examples, the plurality of unit cells may be arranged in a 20×20 array.

In some examples, the plurality of unit cells may be quad-element unit cells (QE-UC) arranged in 2×2 blocks, each QE-UC having 90° rotational symmetry and periodicity of the QE-UC may be between one quarter and one half of an operating wavelength of the FSS.

In some examples, the first pattern element in each quadrant of the QE-UC may be identical, and the second pattern element in each quadrant of the QE-UC may differ between second pattern elements between adjacent quadrants of the QE-UC and second pattern elements at borders between adjacent QE-UCs.

In some examples, adjusting a dimensional property of the second pattern elements between adjacent quadrants of the QE-UC may result in a frequency shift to an upper stopband of the FSS independent of a frequency of a lower stopband of the FSS.

In some examples, the FSS may be formed using monolithic microwave integrated circuit (MMIC) fabrication.

In some examples, the electromagnetic shield may be configured to provide spatial filtering within at least one of Ku band or Ka band.

In some examples, the electromagnetic shield may be configured to provide spatial filtering within at least one of Ku band or Ka band.

In some examples, the device may be configured to operate at an operational frequency of 28 GHz, and the FSS may be configured to function as at least one of an antenna reflector, a beam shaper, a radome, or a radiation absorber.

DETAILED DESCRIPTION

Figure 1:
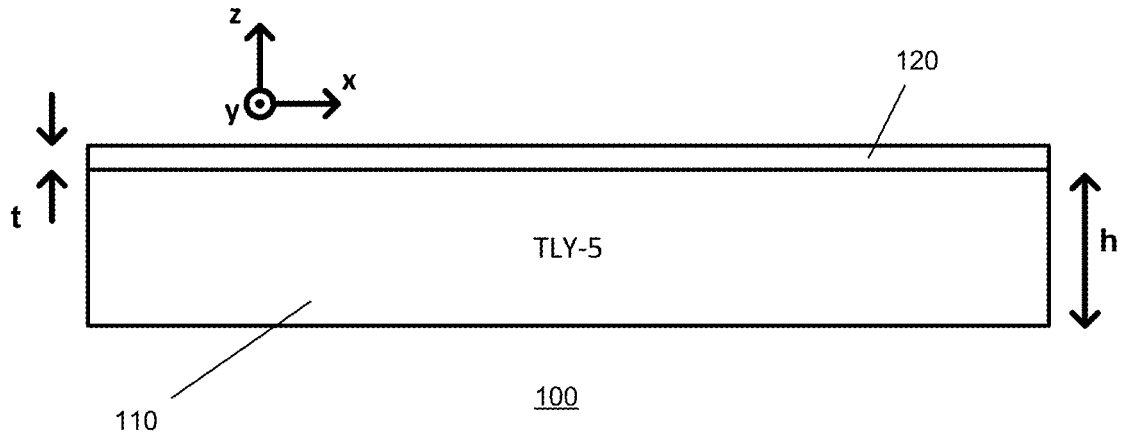
FIG. 1 is a side view of a block diagram of an example FSS structure in accordance with an aspect of the present disclosure.

FIG. 1 illustrates a first example FSS structure 100. The FSS structure 100 includes a dielectric substrate 110 having a height "h" and a metal surface layer 120 formed on a top surface of the substrate 110 and having a thickness "t." In the example of FIG. 1, the dielectric used for the substrate is Taconic TLY-5, which has a relative permittivity $\varepsilon_r$ of 2.2 and a loss-tangent tan δ of 0.0009. Also, in the example of FIG. 1, the metal surface layer 120 may be made from copper, which has a conductivity σ of $5.8\times10^7$ S/m. Also, in the example of FIG. 1, the height "h" of the dielectric is 0.51 mm, and the thickness "t" of the metal surface layer is 35 microns (μm).

Figure 2:
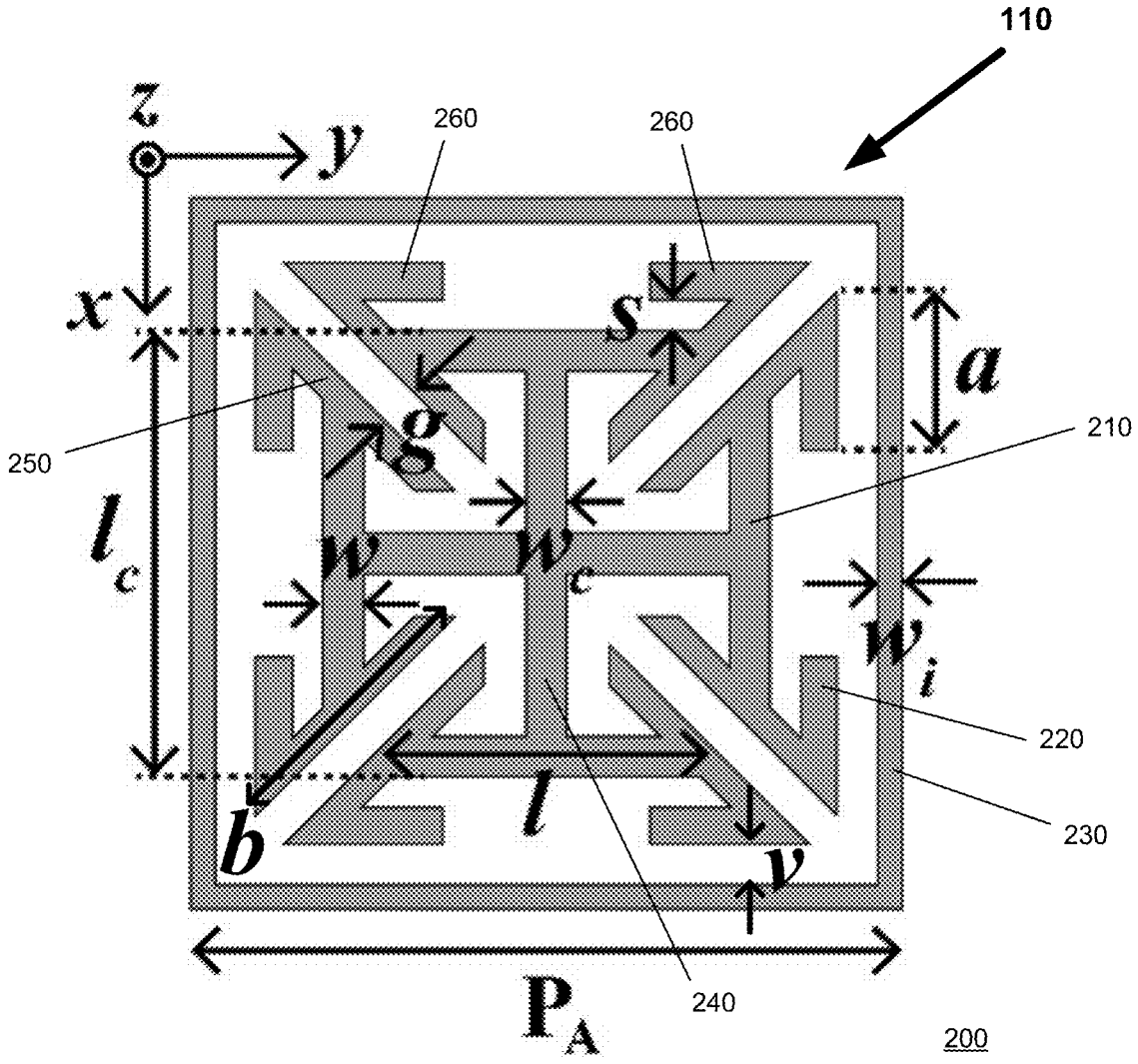
FIG. 2 is a top view of a unit cell of the example FSS structure of FIG. 1.
Figure 3:
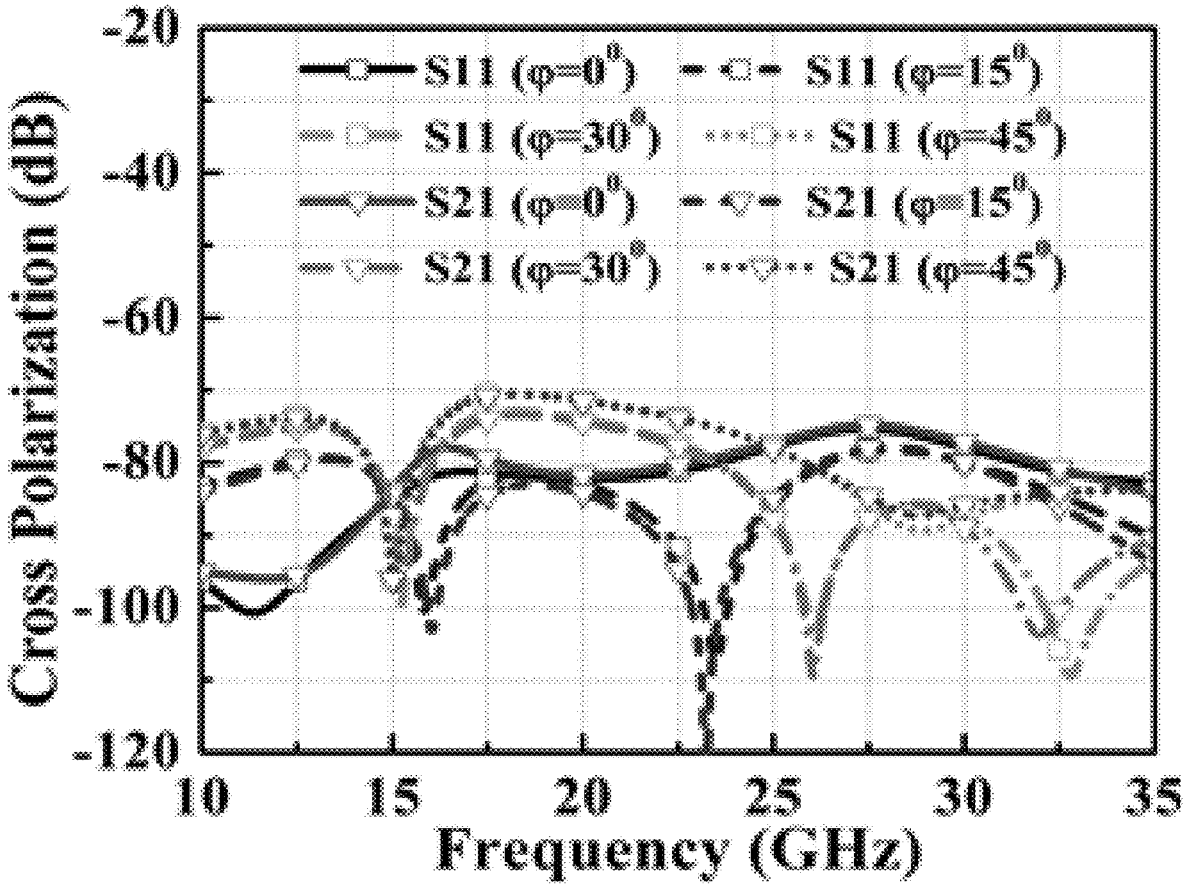
FIG. 3 is a graph showing simulated cross polarization of the example FSS structure of FIG. 1.

FIG. 2 illustrates an overhead view of the FSS structure 100 and an example FSS unit cell pattern. The unit cell 200 in the example of FIG. 2 has a dimension of 3.5 mm×3.5 mm×0.51 mm. The length and width dimensions define a periodicity $P_A$ of the FSS structure 100. For an operational center frequency of 14.44 GHz, these dimensions correspond to $0.168\lambda_0\times0.168\lambda_0\times0.024\lambda_0$. The unit cell has a pattern formed in the metal surface layer 120. The unit cell pattern has a 90° rotational symmetry. This symmetry yields an insensitive filter response even with changes to the polarization angle of an incident EM wave. This is advantageous for having low cross-polarized reflection and transmission characteristics at different polarization angles. For instance, FIG. 3 is a graph showing simulated cross polarization of the example FSS structure 100 of FIGS. 1 and 2. As seen in FIG. 3, XPol may be less than −70 dB for polarized waves having an azimuthal angle φ in the XY plane of the unit cell of any of 0°, 90° and 45°.

Returning to FIG. 2, the unit cell pattern includes three concentric squares or "rings" 210, 220, 230. Additionally, a cross 240 is formed inside the inner-most ring 210. The cross 240 connects opposite sides of the inner-most ring 210 to one another at their midpoints along the X and Y axes. Each of the inner-most ring 210 and the middle ring 220 is split in multiple locations, particularly along the diagonals of the pattern for both rings 210, 220 and at a midpoint of each side for the middle ring 220, thereby forming a pair of broken sides 260 for each side of the middle ring 230. The outer-most ring 230 does not include any breaks. Also, edges of inner-most and middle rings 210, 220 may be connected to one another at the diagonal splits. Each connection 250 between the inner-most and middle rings 210, 220 may extend further inward toward a center of the pattern, but without touching the cross 240.

The pattern can also be characterized as a cross potent (also referred to as a "Jerusalem cross" in the relevant field) with a numeral "7" attached by its midpoint to each free end of the cross potent. As such, the pattern may be characterized as a "modified Jerusalem cross." The pattern further includes a border, which when multiple unit cells are positioned adjacent to one another, forms a mesh grid pattern. In this regard, the modified Jerusalem cross may be considered a first pattern element, and the border forming the mesh grid pattern may be considered a second pattern element.

Figure 4A:
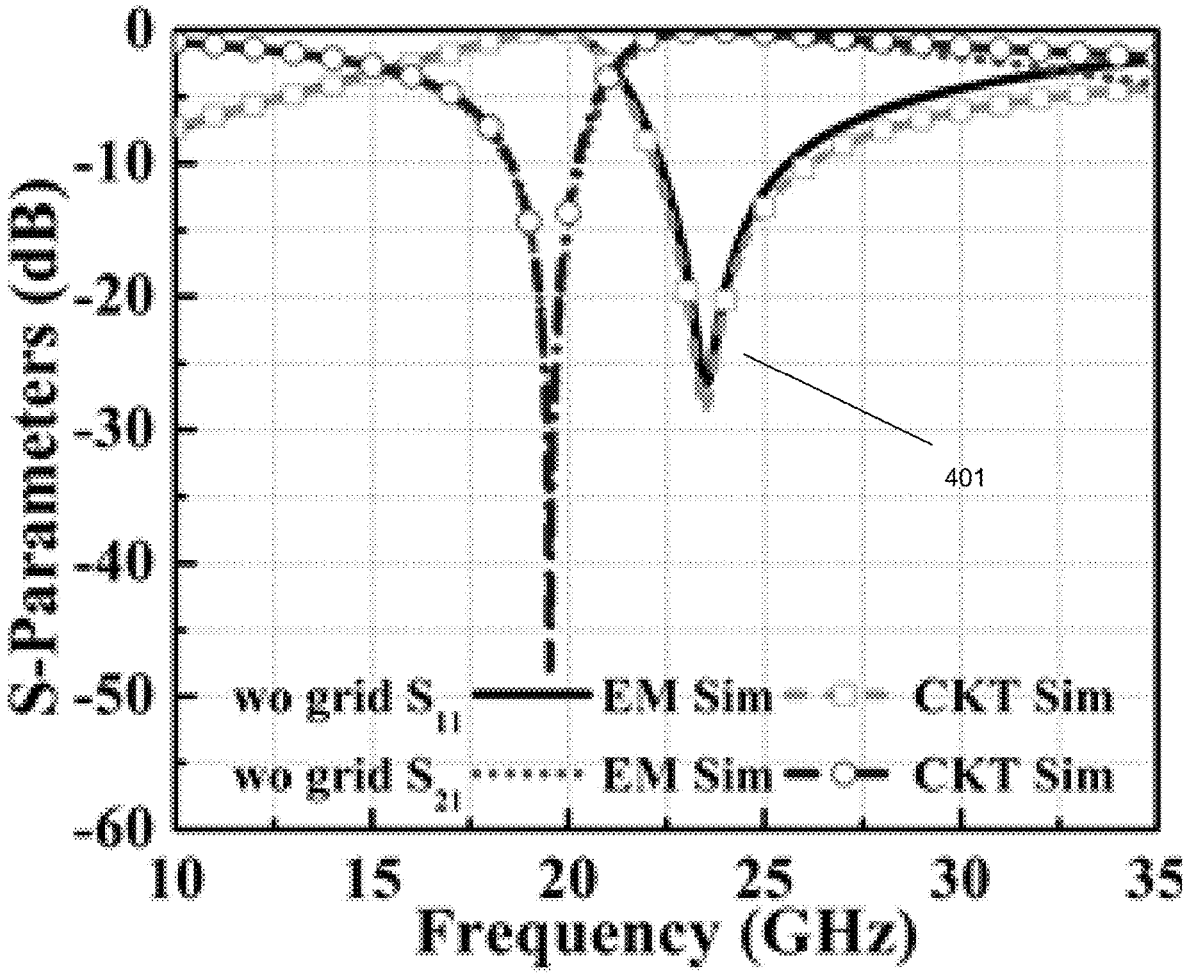
FIGS. 4*a* and 4*b* are graphs showing reflection and transmission characteristics of the example FSS structure of FIG. 1.

Providing the two pattern elements, that is the modified Jerusalem cross in the metal surface layer along with the mesh grid pattern, results in creation of an additional transmission pole. This can be seen in FIGS. 4*a* and 4*b*, which show transmission characteristics of the FSS both without the mesh grid pattern and with the mesh grid pattern, respectively. FIG. 4*a* shows only one transmission pole 401 at about 23 GHz, whereas FIG. 4*b* shows the first transmission pole 411 at 14.46 GHz and a second transmission pole 412 at 27.36 GHz.

Figure 5:
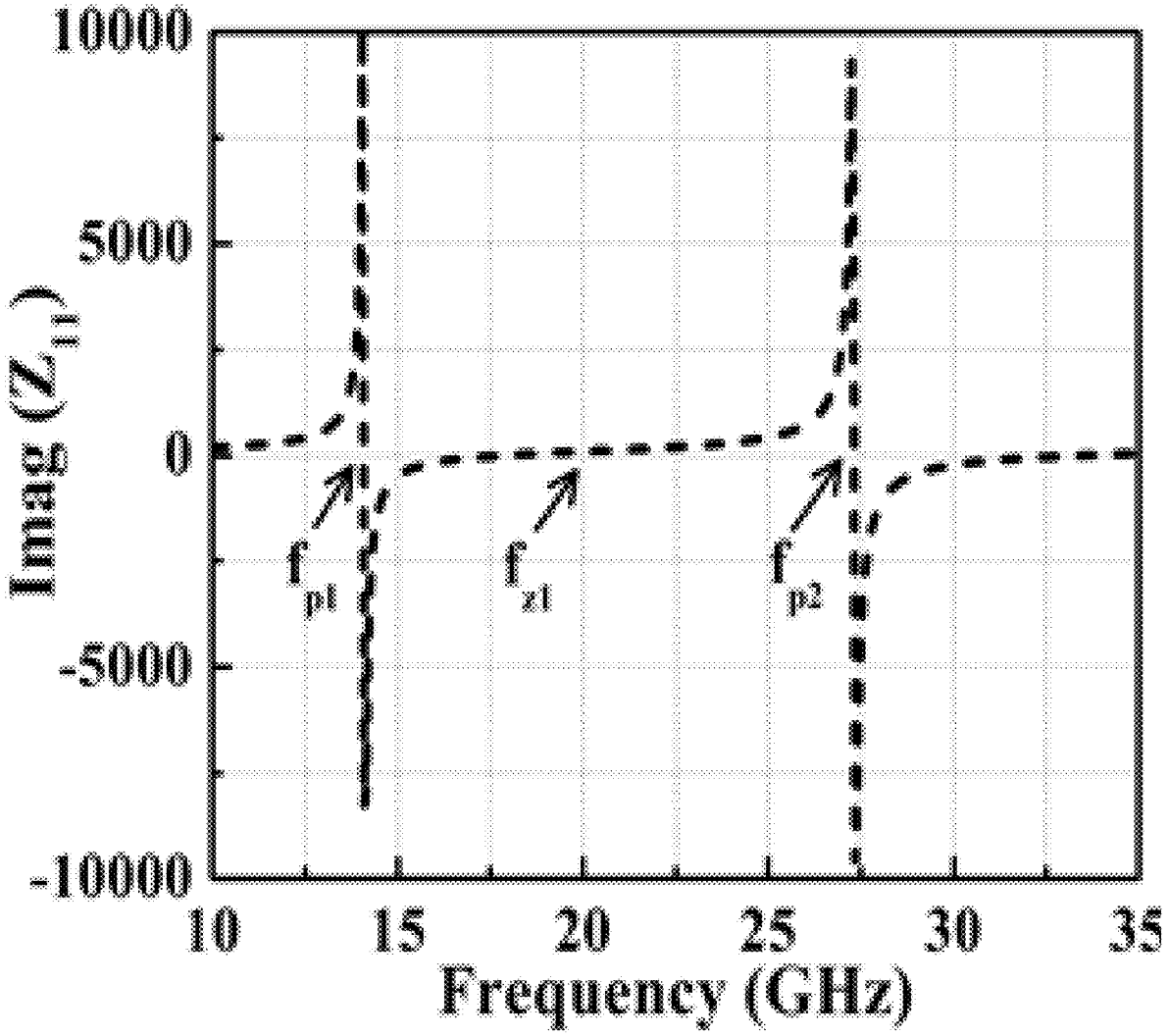
FIG. 5 is a graph showing an imaginary component of an input impedance of the example FSS structure of FIG. 1.

The additional transmission pole can also be seen in FIG. 5, which is a graph showing an imaginary component of the input impedance $Z_{11}$ of the FSS structure 100 of FIGS. 1 and 2. As shown in FIG. 5, the imaginary component $Z_{11}$ indicates the presence of a first transmission band with center frequency of 14.04 GHz at pole $f_{p1}$, and a second transmission band with center frequency of 27.36 GHz at pole $f_{p2}$. A transmission zero $f_{z1}$ is characterized by an inflection point in the graph, which is positioned at about 20 GHz.

Returning to FIG. 4*a*, the FSS including only the modified Jerusalem cross and not the mesh grid presents a transmission zero at 19.56 GHz with reflectivity of 98.7%, and a transmission pole at 23.56 GHz for 99% signal transmission.

Figure 4B:
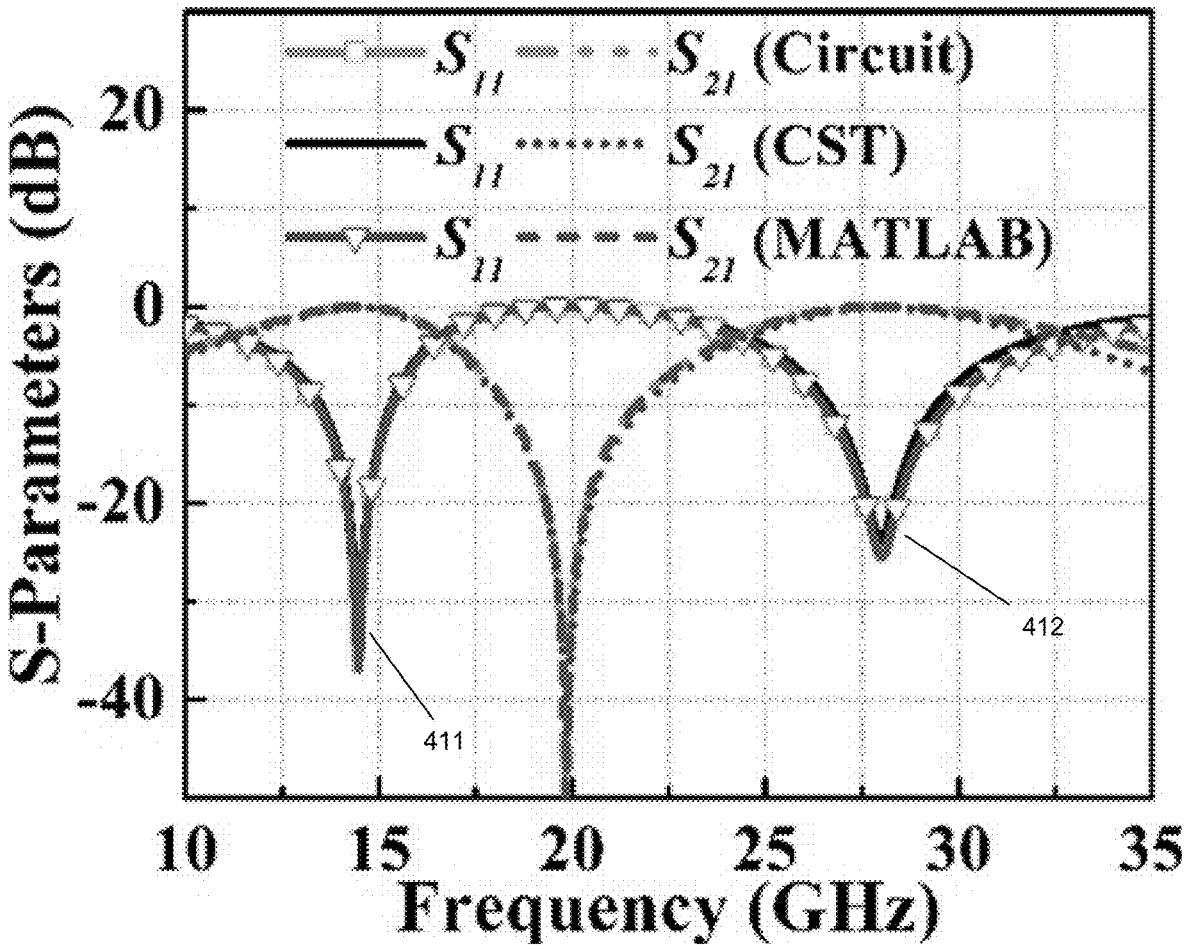

In FIG. 4*b*, the fractional bandwidths (FBW) of the two passbands are 12.71% for the first passband centered at 14.46 GHz (13.496-15.328 GHz) and 10% for the second passband centered at 28.04 GHz (26.67-29.478 GHz). The FBWs may be characterized in terms of $S_{11}$ being less than −10 dB. Simulations show that at the TE modes, the FBW for the lower passband of the FSS structure 100 is decreased from 12.71% to 6.27%, and the FBW for the higher passband of the FSS structure 100 is decreased from 10% to 4.43%. In a similar vein, at the TM modes, the FBW for the lower passband of the FSS structure 100 increases to 18.2%, and the FBW for the higher passband of the FSS structure 100 increases to 13%. FIG. 4*b* also shows that the example FSS structure 100 of FIGS. 1 and 2 has a transmission zero at 19.88 GHz and possesses a stopband resonance from 18.898 GHz to 20.963 GHz with an FBW of 10.36%. The FBW may be characterized in terms of $S_{21}$ being less than −15 dB.

Returning to FIG. 2, the design of the pattern of the FSS structure 100 shown in FIG. 2 has a relatively simple geometry. Particularly, the entire geometry can be characterized using as few as nine parameters: a width "w" or "$w_c$" of the inner-most and middle rings 210, 220, the cross 240 and the connection 250 (all of which may be the same width); an overall length and width "$P_A$" of the unit cell pattern; a width "$w_i$" of the outer-most ring 230; a length "a" of each broken side 260 of the middle ring 220; a length "1" of each side of the inner-most ring, a length "b" of the connections 250 extending toward the center of the pattern; a distance "s" between the inner-most ring 201 and the middle ring 220; a distance "v" between the middle ring 220 and the outer-most ring 230; and a length "$l_c$" of the inner-most ring 210. In one example construction of the pattern, the following dimensions were chosen: $P_A$=3.5 mm, w=0.2 mm, $w_i$=0.12 mm, s=0.15 mm, a=0.78 mm, and $l_i$=1.8 mm. Other dimensions such as "l," "b" and "v" were found to have less impact on optimization of the pattern. The simplification of the geometry makes scaling the size of the unit cell down easier.

A conventional Jerusalem cross consists of a cross dipole with end loaded capacitive arms having properties of a stable filter response with a transmission zero at the resonant frequency. Arms of the cross dipole and the inter-element gaps between respective unit cells yields inductances and capacitances. By contrast, in the modified Jerusalem cross of FIG. 2, the end-loaded capacitive arms of the Jerusalem cross are extended both in horizontal and vertical directions, such that they form the shape of a plow instead of a cross. This modification to the end-loaded capacitive arms gives an additional capacitive loading to the structure, which in turn increases an overall capacitance of the unit cell.

Figure 6:
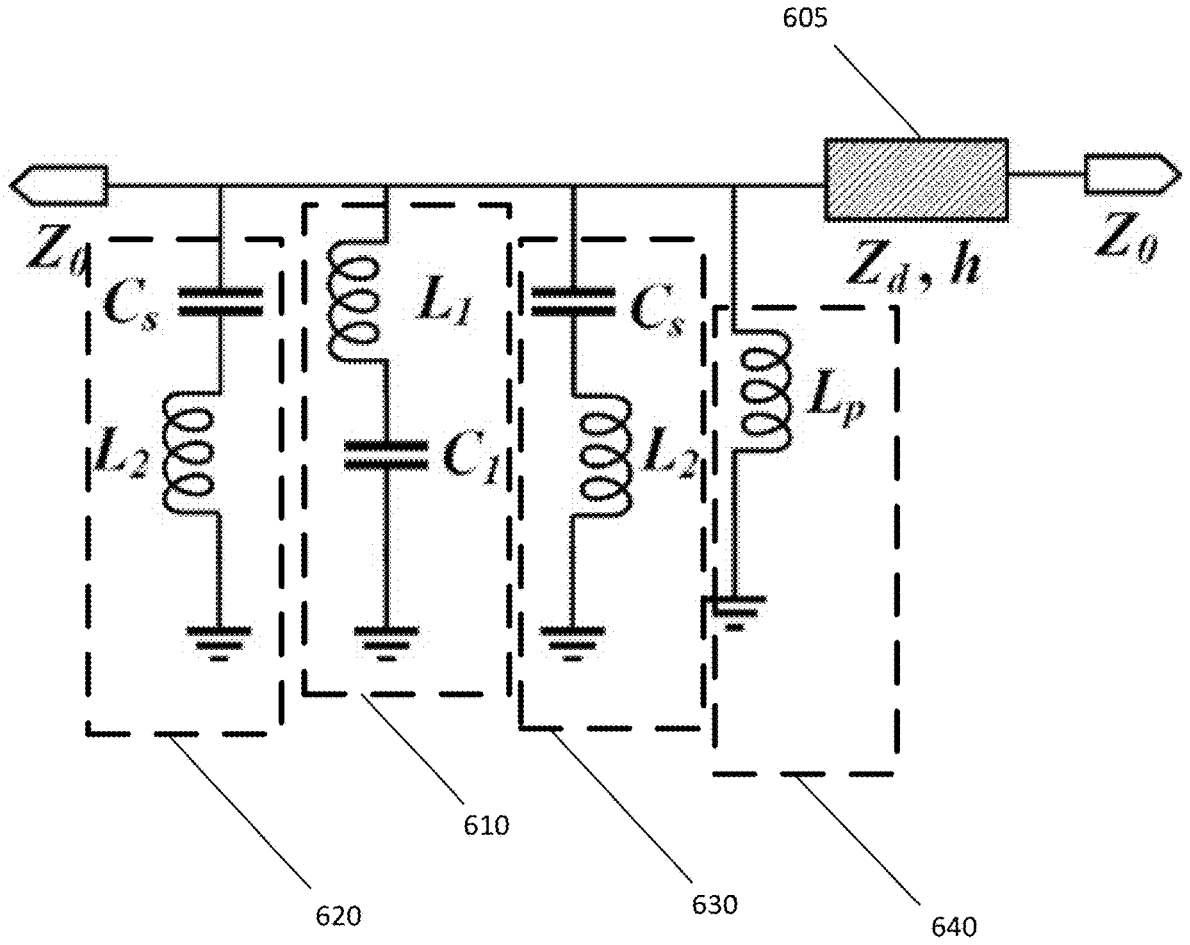
FIG. 6 is a circuit diagram showing an equivalent circuit of the example FSS structure of FIG. 1.

FIG. 6 is a circuit diagram showing an equivalent circuit of the FSS structure 100 of FIGS. 1 and 2. In FIG. 6, the dielectric substrate is modelled as a transmission line 605 having length h.

A characteristic impedance of the line may be characterized as $Z_d$, which may be calculated according to the following equation:

$$Z_d = \frac{Z_0}{\sqrt{\varepsilon_r}} \tag{1}$$

in which $Z_0$ is the free space impedance.

The metal surface layer is represented includes a modified Jerusalem cross and a metal square ring at the periphery. The modified Jerusalem cross includes each of a center cross dipole and a pair modified metal strips loaded on to the ends of the cross dipole. The center cross dipole of the modified Jerusalem cross is represented in block 610 by a series LC circuit having inductance $L_1$ and capacitance $C_1$. This is representative of the standard properties exhibited by a conventional Jerusalem cross, with an additional capacitance due to the presence of the modified Jerusalem cross. The modified metal strips are represented by blocks 620 and 630, respectively, on either side of the center cross dipole, by additional series LC circuits, each having inductance $L_2$ and capacitance $C_s$. The outer square rings are represented by block 640 as having an inductance $L_p$. When the unit cells are adjoined to form a full array, the outer square rings of the adjacent unit cells together form a metal wire grid. The wire grid gives a shunt inductance shown in block 640 as $L_p$.

The inductances $L_1$ and $L_p$ may be determined according to the following equation:

$$L_i = \frac{\mu_0 P}{2\pi}\ln\left(\frac{1}{\sin(m\pi/2P_A)}\right) \tag{2}$$

In which value of "m" is substituted as $w_e$ in order to derive the inductance $L_1$, and with $2w_i$ in order to derive the inductance $L_p$. The capacitance $C_1$ may be determined using the following equation:

$$C_1 = \varepsilon_0\varepsilon_{eff} = \frac{2P}{\pi}\ln\left(\left(\sin\frac{\pi}{2}(1 - l_c/P_A)^{-1}\right)\right) \tag{3}$$

In which $\varepsilon_{eff}$ is the effective dielectric constant of the substrate and its value is $(1+\varepsilon_r)/2$.

The inductance $L_2$ and capacitance Cs values of the end loaded metal strips are determined using following respective equations:

$$L_2 = 2\times10^{-4}l\left\{\ln\left(\frac{l}{w+t}\right) + 1.193 + 0.2235\frac{w+t}{l}\right\} \tag{4}$$

-continued $$C_2 = \frac{2w}{\pi}\varepsilon_0\varepsilon_{eff}\cosh^{-1}(D/g) \tag{5}$$

In which "l" is substituted in m units to obtain $L_2$ in nH, and in which "D" is substituted as "l+g" and "w" is the width of the metal strip.

Using the values derived from Equations (2)-(5), an impedance of the FSS may be determined using the following equation:

$$Z_s = \frac{j\omega L_p(1-\omega^2L_1C_1)(1-\omega^2L_2C_s)}{\omega^4C_1C_s(L_1L_2 + 2L_pL_1 + L_pL_2) - \omega^2(L_1C_1 + L_2C_s + L_pC_1 + 2L_pC_2) + 1} \tag{6}$$

The above equation yields three values for which $Z_S=0$, meaning that three transmission zeros exist. These transmission zeros are located at frequencies: 0 (DC signal), $\frac{1}{2}\pi\sqrt{L_1C_1}$ and $\frac{1}{2}\pi\sqrt{L_2C_s}$. Transmission poles of the FSS are identifiable by solving for the values of ω for which the denominator of the equation equals 0.

The equivalent circuit of the FSS structure followed by a cascaded transmission line may further be represented by an overall ABCD matrix as shown in the following equation:

$$\begin{bmatrix} A & B \\ C & D \end{bmatrix} = \begin{bmatrix} \cos\beta h & jZ_d\sin\beta h \\ \frac{\cos\beta h}{Z_s} + j\frac{\sin\beta h}{Z_d} & \cos\beta h + j\frac{Z_d\sin\beta h}{Z_s} \end{bmatrix} \tag{7}$$

In which β is the phase constant inside the dielectric substrate. The value of β is 2π/λ, where λ is the guided wavelength for the dielectric material.

Because the FSS structure has a fourfold 90 degree rotational symmetry, the same equivalent circuit may be used to characterize for both y-polarized (TE) and x-polarized (TM) incident waves. Reflection (R) and transmission (T) coefficients may be related to the ABCD parameters according to following equations:

$$R_{x/y} = \frac{A + B/Z_0 - CZ_0 - D}{A + B/Z_0 - CZ_0 + D} \tag{8}$$

$$T_{x/y} = \frac{2}{A + B/Z_0 - CZ_0 + D} \tag{9}$$

After evaluating $R_{x/y}$ and $T_{x/y}$, magnitudes of reflection and transmission coefficients may be determined by substituting $S_{11}=20\log|R_{x/y}|$ and $S_{21}=20\log|T_{x/y}|$. These calculations may be performed using a software program such as MATLAB.

The equivalent circuit of the FSS structure is also useful for extracting circuit parameter values that produce a desired circuit response. For instance, a full wave simulation may be run in order to derive a desired response for the FSS structure, and then circuit parameter values may be extracted to match a circuit response with the full wave simulated result.

Figure 7A:
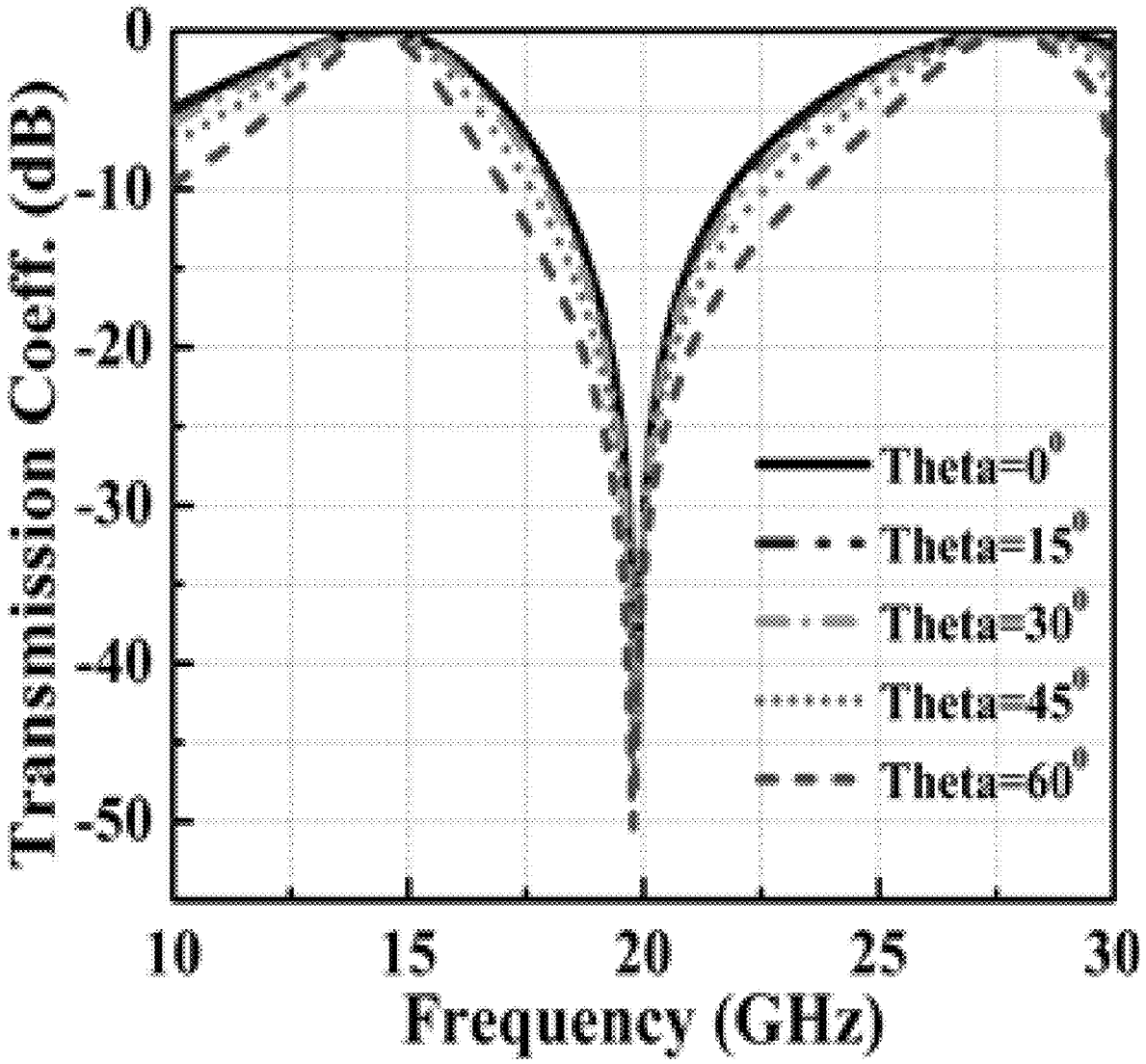
FIGS. 7*a* and 7*b* are graphs showing simulated transmission characteristics of the example FSS structure of FIG. 1.
Figure 7B:
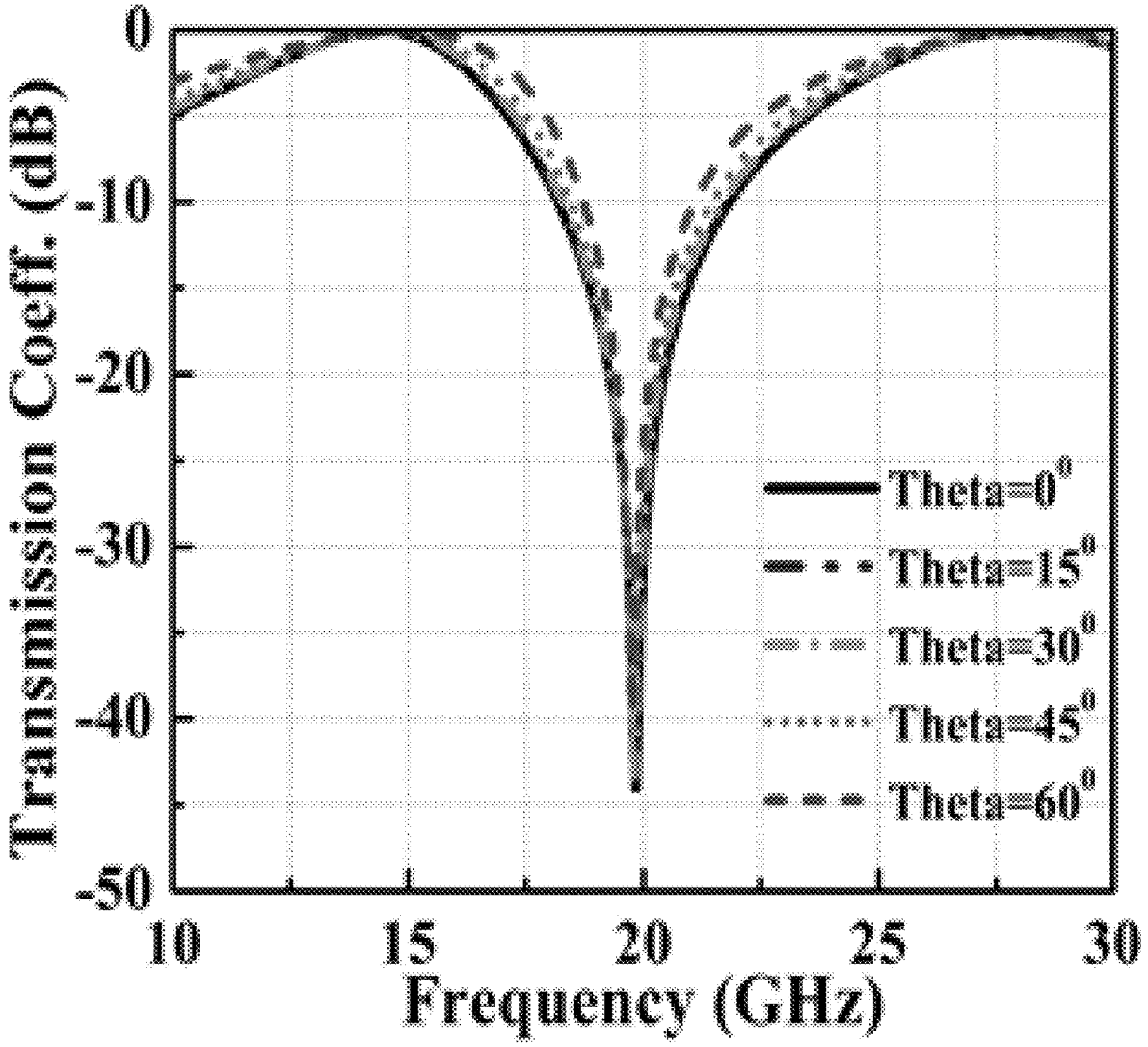

The additional transmission pole yielded by the modified Jerusalem cross also results in the FSS structure exhibiting highly stable spatial filter characteristics even as the incident angle and polarization of the EM wave changes. FIGS. 7*a* and 7*b* are graphs showing simulated transmission characteristics of the FSS structure 100 of FIGS. 1 and 2 at different oblique incident angles of EM waves for TE and TM modes of polarization, respectively, at 0°, 15°, 30°, 450 and 60°. As can be seen from the figures, the modified Jerusalem cross consistently exhibits a transmission zero at 19.56 GHz, even as the angle of incidence changes all the way from 0° to 60°.

Figure 8:
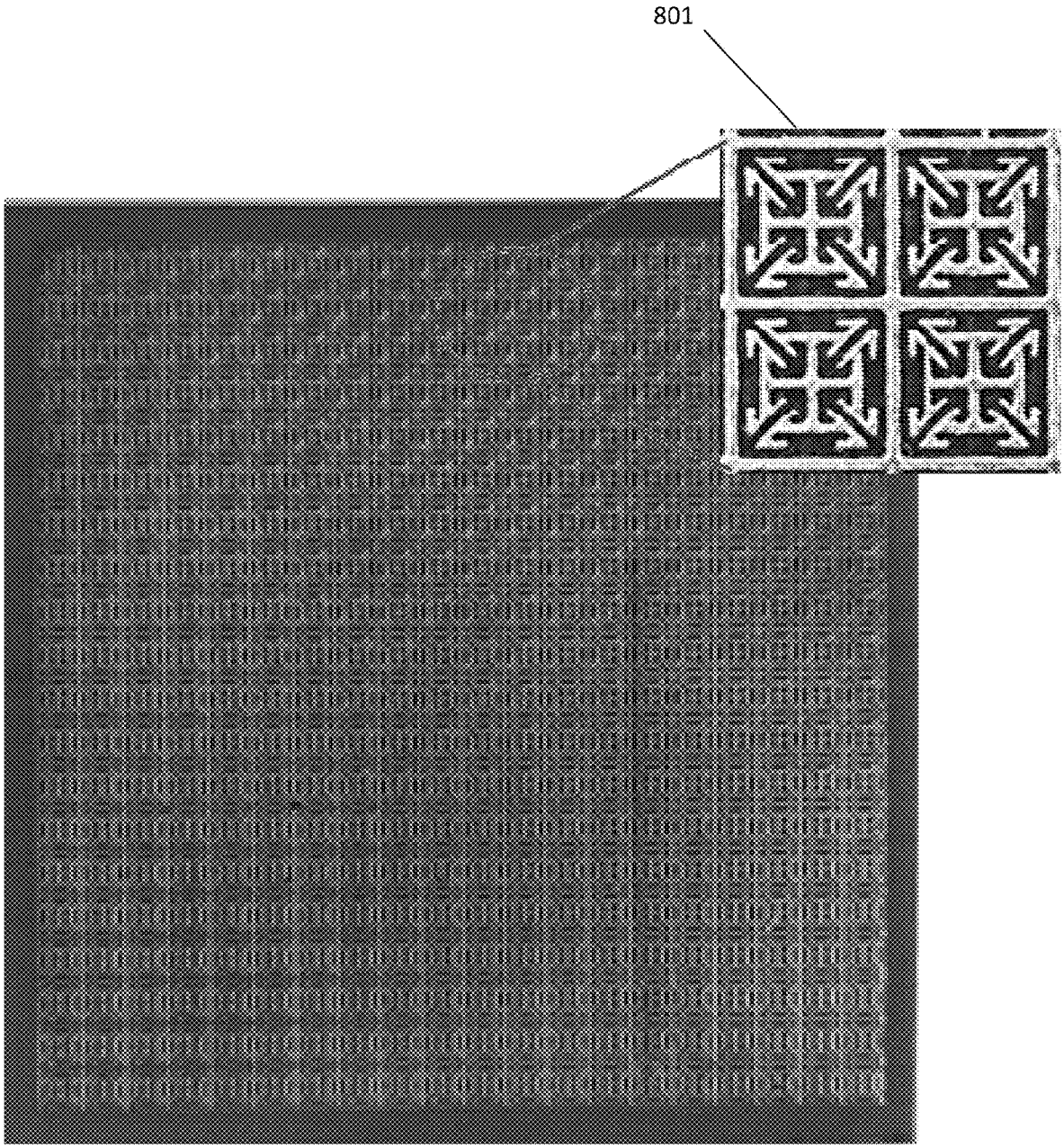
FIG. 8 is a top view of a prototype FSS in accordance with an aspect of the present disclosure.

Unit cells, such as the example FSS unit cell structure 100 shown in FIGS. 1 and 2, may be arranged in a planar array in order to form an FSS. FIG. 8 illustrates an image of an example FSS 800 including four hundred FSS unit cells 801 (zoomed section for sake of clarity) arranged in a 20-by-20 array. In some examples, the FSS unit cells 801 may be completely planar. For instance, each one of the FSS unit cells 801 may be structured in the manner of the example FSS unit cell structure 100 of FIGS. 1 and 2.

Figure 9:
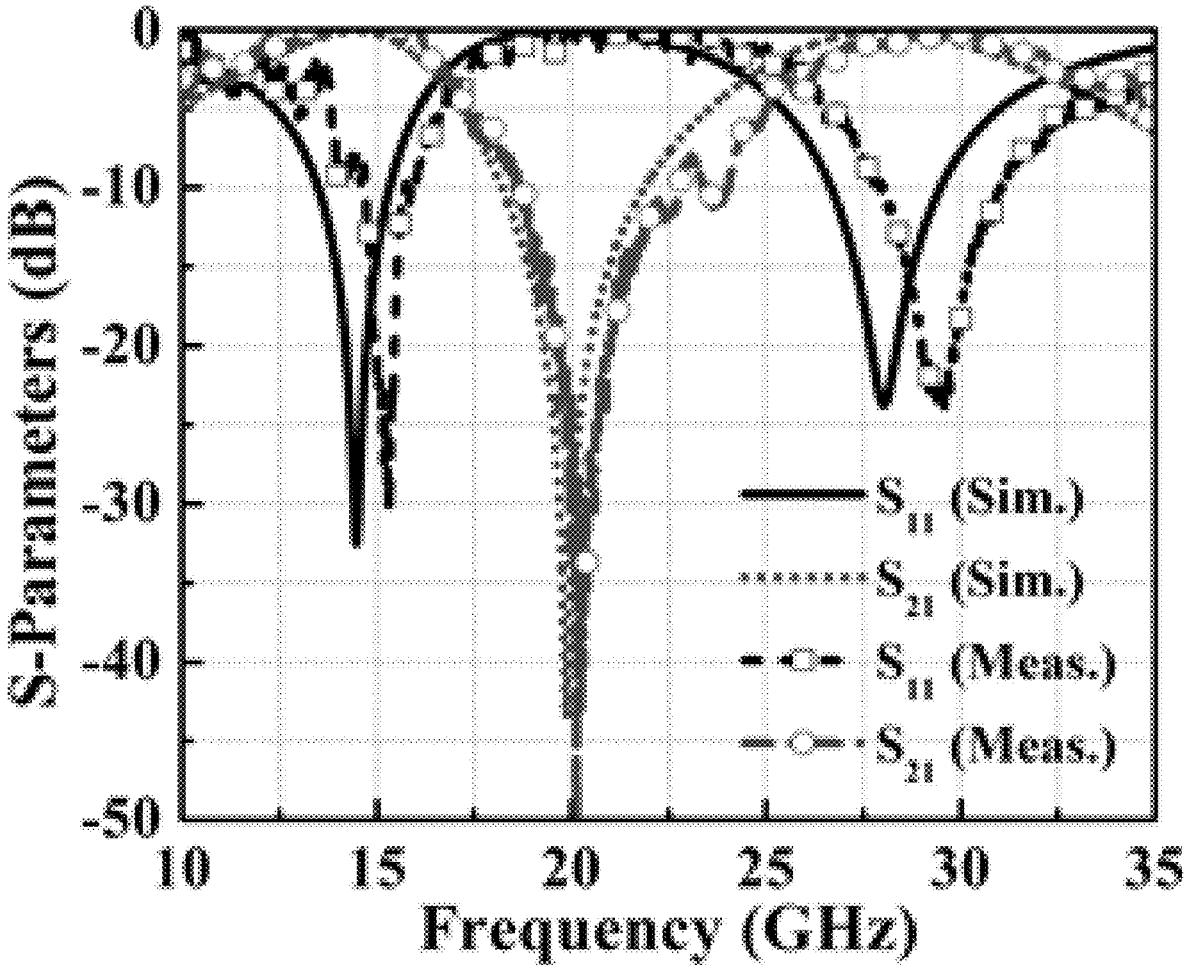
FIG. 9 is a graph showing simulated transmission characteristics of the prototype FSS of FIG. 8.

FIG. 9 is a graph showing both simulated and measured reflection ($S_{11}$) and transmission ($S_{21}$) characteristics of the FSS 800 of FIG. 8. As shown in FIG. 9, simulated results show dual transmission bands at center frequencies of 14.46 GHz and 28.04 GHz. These passbands fall within range of the Ku and Ka bands, respectively. Also, a wide reflection band centered around 19.88 GHz is demonstrated by the simulations. Measured results from a prototype of the example FSS 800 of FIG. 8 show the transmission poles to be located at 15.31 GHz and 29.39 GHz and that the transmission zero is at 20.16 GHz with a stop band rejection of −49.71 dB. Additionally, both the measured and simulated results shown in FIG. 9 demonstrate that the FSS 800 exhibits a transmission zero at about 20 GHz, and has transmission losses within both the first and second passbands that are less than 0.55 dB for which $S_{11}$ is less than −10 dB from 14.71 to 15.87 GHz (FBW of 7.59%) and 27.92 to 31.07 GHz (FBW of 10.68%), respectively, and having a measured stopband for which $S_{21}$ is less than −15 dB from 19.15 to 21.5 GHz (FBW of 11.56%).

Figure 10A:
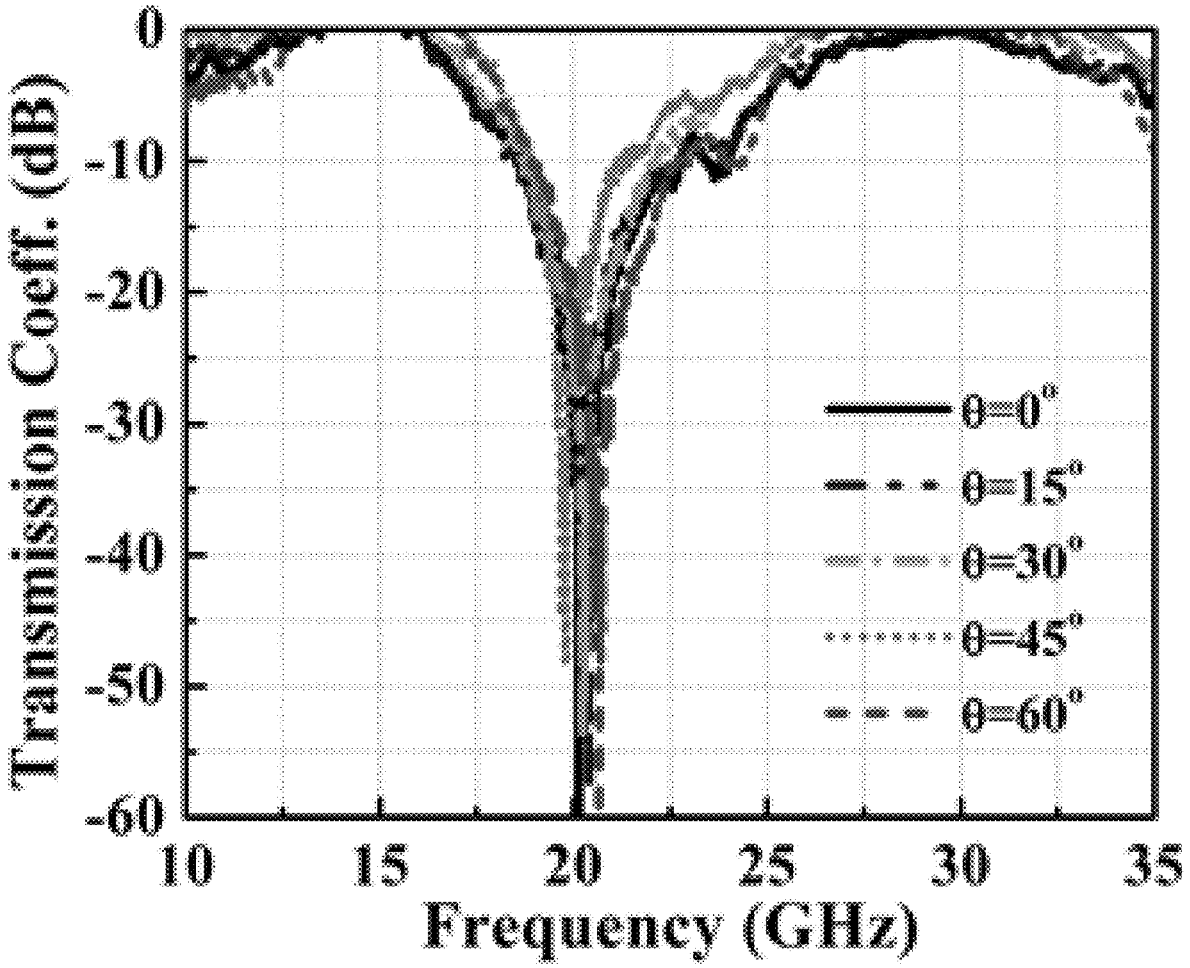
FIGS. 10*a* and 10*b* are graphs showing reflection and transmission characteristics of the prototype FSS of FIG. 8.
Figure 10B:
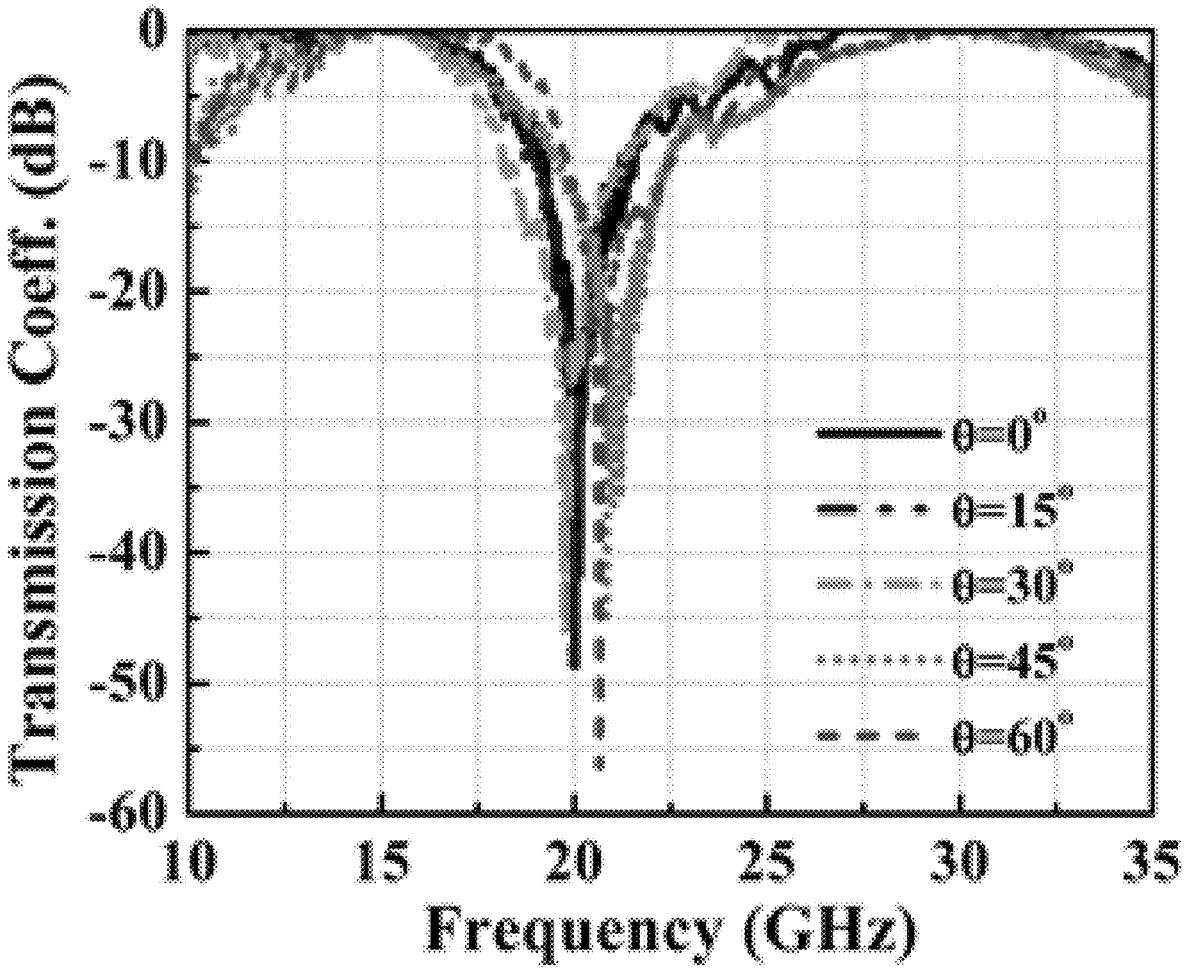

FIGS. 10*a* and 10*b* are graphs showing simulated transmission characteristics of the FSS 800 of FIG. 8 at different oblique incident angles of EM waves for TE and TM modes of polarization, respectively, ranging from 0° to 15° to 30° to 45° to 60°. The wave impedances of an FSS vary according to the oblique angle (0) (or angle of incidence) of both the TE and TM waves. The impedances may be characterized according to the following equations:

$$Z_{TE}=Z_0/\cos\theta \tag{10}$$

$$Z_{TM}=Z_0\cos\theta \tag{11}$$

The changes in wave impedance result in changes in the quality factor of the FSS as the oblique angle θ changes, such that the passband quality factor increases for the TE mode of polarization and decreases for the TM mode of polarization. Changes to the stopband quality factor as a function of θ follow the opposite trend, that is a decrease for the TE mode and include for the TM mode.

As shown in FIGS. 10*a* and 10*b*, frequency shifts at the lower and higher passbands of the FSS 800 of FIG. 8 are within 0.86% of one another for the TE mode, and within 1.71% of one another for the TM mode. This shift in frequency amounts to a shift of less than 0.3% at the transmission zero. Additionally, the figures show a maximum frequency shift of 1.97% for TE mode and 3.19% for TM mode at incident angle as high as 60°.

Figure 11:
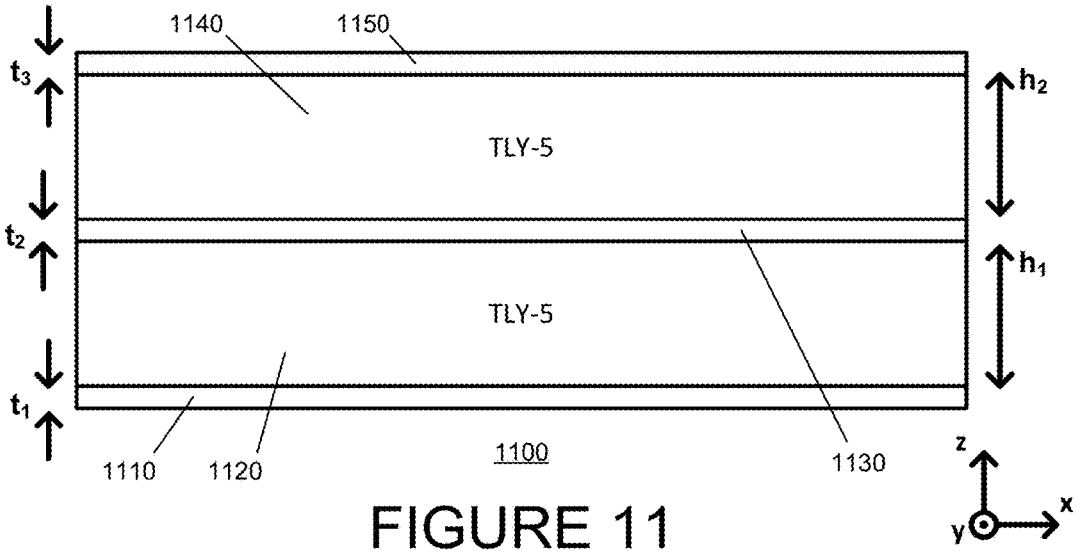
FIG. 11 is a side view of a block diagram of another example FSS structure in accordance with an aspect of the present disclosure.

FIG. 11 illustrates a second example unit cell of an FSS structure 1100. The FSS structure 1100 includes a first metal layer 1110 having a thickness $t_1$, a first dielectric substrate 1120 formed on the first metal layer 1110 and having a height $h_1$, a second metal layer 1130 formed on the first dielectric substrate 1120 and having a thickness $t_2$, a second dielectric substrate 1140 formed on the second metal layer 1130 and having a height $h_2$, and a third metal layer 1150 formed on the second dielectric substrate 1140 and having a thickness $t_3$. The overall height of the FSS structure in the Z-axis direction may be less than a quarter of the operating wavelength $\lambda_0$, and in some instances, may be less than even a twelfth of the operating wavelength $\lambda_0$. For instance, in FIG. 11, the example FSS structure 1100 has an overall height of $0.069\lambda_0$. Thus, the structure 1100 has a relatively low profile.

In the example of FIG. 11, each of the dielectric substrates 1120, 1140 may be made of the same material as the dielectric substrate in the example FSS structure 100 of FIGS. 1 and 2. Each dielectric substrate 1120, 1140 may have a height of 0.51 mm and conductivity σ of $5.8\times10^7$ S/m. The use of two dielectric layers, as opposed to a single layer as in FIG. 1, achieves a second order filter response.

The mesh grid pattern of the second metal layer 1130 provides an inductive loading to the unit cell. A magnetic flux is produced due to current in the mesh grid pattern. The magnetic flux links to the first and third metal layers because the dielectric substrates are relatively thin. This coupled magnetic field creates additional current on the first and third metal layers. Overlapping area between the metal layers separated by the dielectric layers generates additional capacitive coupling because of potential differences between the metal layers and the buildup of opposite polarity charge across the metal layers.

Figure 12:
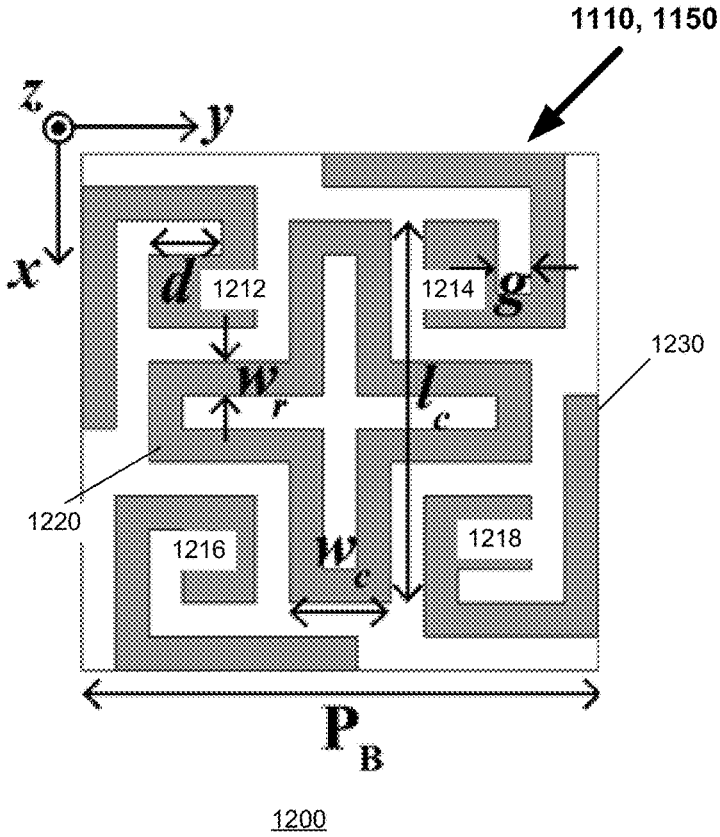
FIG. 12 is a top view of an example unit cell of the FSS structure of FIG. 11.
Figure 13:
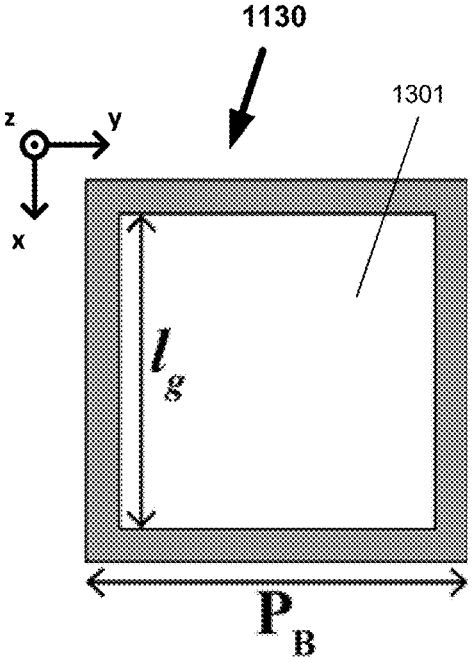
FIG. 13 is a top view of a layer of the FSS structure of FIG. 11.

FIG. 12 illustrates an overhead view of each of the first and third metal layers 1110, 1150 of the FSS structure 1100. FIG. 13 illustrates an overhead view of the second metal layer 1130.

With regard to FIG. 12, each of the first and third metal layers 1110, 1150 has a pattern that repeats along each of the unit cells of the FSS. FIG. 12 shows the pattern of a single unit cell 1200. The unit cell 1200 in the example of FIG. 12 has a dimension of 2.3 mm×2.3 mm×1.02 mm. For an operational center frequency of 20.3 GHz, these dimensions correspond to $0.156\ \lambda_0\times0.156\lambda_0\times0.069\lambda_0$, where $\lambda_0$ is the free space wavelength at the center frequency of lower passband. The unit cell 1200 has a pattern formed in the third metal layer 1150. The length and width dimensions define a periodicity $P_B$ of the FSS structure 1100.

The unit cell pattern has a 90° rotational symmetry. This symmetry yields an insensitive filter response even with changes to the polarization angle of an incident EM wave. This is advantageous for having co-polarized transmission and reflection characteristics at different polarization angles of the incident EM waves.

Figure 14:
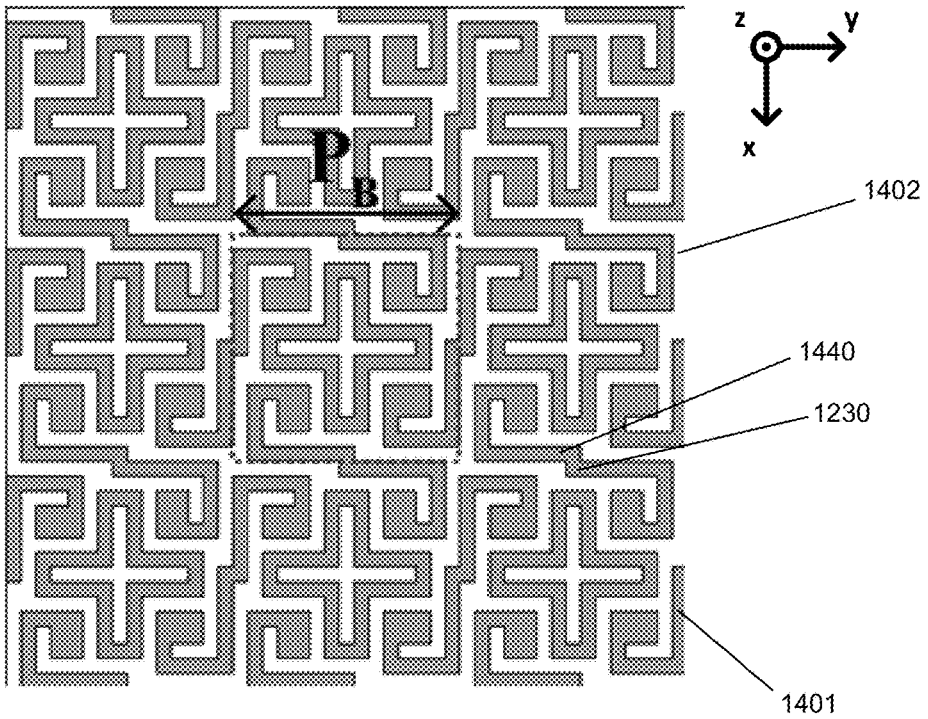
FIG. 14 is a top view of multiple unit cells of the FSS structure of FIG. 11.

The unit cell pattern also includes four spiral resonators 1212, 1214, 1216, 1218 to enhance the inductance. In the example of FIG. 12, each spiral resonator includes four segments or arms connected to one another to form a spiral pattern. In the example of FIG. 12, the spiral pattern for each spiral resonator is in the same rotational direction, which in FIG. 12 is counterclockwise but in other examples may be clockwise. Outermost segments of the spiral resonators 1212, 1214, 1216, 1218 are positioned along respective edges of the unit cell 1200 in order for the end 1230 of one spiral arm to adjoin the end of a spiral arm of an adjacent unit cell. For example, FIG. 14 shows a 3-by-3 section of an FSS, in which a center FSS unit cell is adjacent to four other FSS unit cells. It can be seen in FIG. 14 that the end 1230 of the center FSS unit cell 1401 adjoins the end 1440 of an adjacent FSS unit cell 1402. This connection provides for interconnection of the unit cells via the spiral resonators. The spiral resonators 1212, 1214, 1216, 1218 can be modeled as series L-C resonant circuit with inductance $L_1$ and capacitance $C_1$.

The unit cell pattern also include a looped resonant element 1220 in the shape of a cross is positioned at the center of the pattern. The looped cross 1220 provides additional capacitive coupling with the spiral resonators, in order to increase the capacitive loading at frequencies that are lower than the series resonant frequency of the looped cross 1220. The looped cross can be modeled as a series L-C circuit with inductance $L_2$ and capacitance $C_2$. Dimensions of the looped cross 1220 include an overall length of the cross arms, $l_c$, an overall width of the cross arms $w_e$, and a width of the segments forming the loop $w_r$, and dimensions of the spiral arms include a length "d" of an innermost segment and a width "g" of a gap between the first and third innermost segments (which are parallel to one another). In one example construction of the pattern, the following dimensions were chosen: $P_B$=2.3 mm, $w_c$=0.45 mm, $l_c$=1.7 mm, g=0.15 mm, d=0.32 mm, $w_r$=0.15 mm.

With regard to FIG. 13, the second metal layer 1130 may be a wire mesh grid. Each unit cell 1200 of the wire mesh grid may correspond to a single box of the grid, whereby the box has a mesh hole 1301 having side length $l_g$. The wire mesh grid acts as shunt inductance, for which the inductance value $L_P$ is given by the following equation:

$$L_P = \mu_0 \mu_{eff} \frac{P}{2\pi} \ln\left(\frac{1}{\sin\frac{\pi}{2}(1 - l_g / P)}\right) \tag{12}$$

where $\mu_0$ is the free space permeability, $\mu_{eff}$ is effective relative permeability and $P_B$ is 2.3 mm. For the dielectric substrate layers 1120, 1140 used in the example FSS structure 1100 of FIGS. 11-13, the value of $\mu_{eff}$ is equal to 1.

Inclusion of the spiral resonators in each of the first metal layer 1110 and the third metal layer 1130 of the example FSS structure 1100 creates an effect of electric and magnetic coupling between the spiral resonators because of high surface current. This coupling may be characterized as a mutual inductance $L_m$ and a mutual capacitance $C_m$. The coupling effectively changes the inductance for each of the spiral resonators from $L_1$ to $(L_1+L_m)$ and the capacitance for each of the spiral resonators from $C_1$ to $(C_1-C_m)$. Additionally, a mutual capacitance is introduced between the spiral resonators and the looped crosses due to fringing of the electric field between the overlapping area of the first and third metal layers 1110, 1150. The mutual coupling can be characterized as a capacitance $C_{m1}$, and adds to the overall capacitance of the structure. Electric and magnetic coupling paths between the spiral resonators of the first and third metal layers may be characterized as an admittance inverter $J=\omega C_m$ and an impedance inverter $K=\omega L_m$, respectively.

The FSS structure 1100 may be characterized as two first-order elements cascaded with one another and having an inductive grid in between the first-order elements. In this regard, each of layers 1110/1120 and 1140/1150 may be thought of as separate first-order elements, and the second metal layer 1130 functions as the inductive grid in between. The cascaded first order elements and inductive grid yield a second-order element exhibiting a second-order filter response having two nearby transmission poles and two nearby transmission zeros in the passband and stopband respectively. Current in the metal grid of the second metal layer 1130 creates a magnetic field around the metal grid. The magnetic field couples to the first and third metal layers 1110, 1150 due to the relatively small thickness of the dielectric substrate layers 1120, 1140 and resulting low distance between the metal layers. This coupled magnetic field, in turn, creates electrical current on both the top and bottom (or first and third) metal layers of the FSS.

Figure 15:
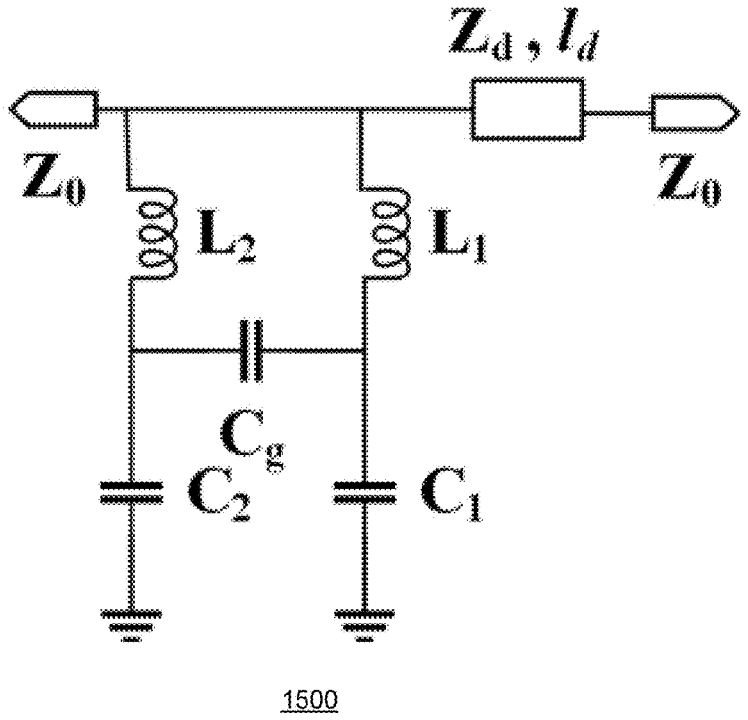
FIG. 15 is a circuit diagram showing an equivalent circuit of a first-order element of the FSS structure of FIG. 11.

FIG. 15 is a circuit diagram showing an equivalent circuit 1500 of a first order element of the FSS structure 1100. The equivalent circuit 1500 shows that the capacitances and inductances of the first-order element form a Π network.

An input admittance of the first-order element may be calculated from the equivalent circuit 1500 by converting the inductances and capacitances of the Π network into a T network form. This may be accomplished using the following equation:

$$Y_{in} = \left(\frac{1}{Y_1 + Y_2} - \frac{\omega^2 L_1 L_2}{(1/j\omega C_g) + j\omega(L_1 + L_2)}\right)^{-1} + \frac{\sqrt{\varepsilon_r}}{Z_0}\left(\frac{1 + j\sqrt{\varepsilon_r}\tan(\beta h)}{\sqrt{\varepsilon_r} + j\tan(\beta h)}\right) \tag{13}$$

for which the values $Y_1$ and $Y_2$ are:

$$Y_1 = \left(\frac{j\omega(L_1 C_1 C_g^{-1} + L_1 + L_2) + (1/j\omega C_g)}{C_1 C_g^{-1} - \omega^2 C_1 (L_1 + L_2)}\right)^{-1} \tag{14}$$

$$Y_2 = \left(\frac{j\omega(L_2 C_2 C_g^{-1} + L_1 + L_2) + (1/j\omega C_g)}{C_2 C_g^{-1} - \omega^2 C_2 (L_1 + L_2)}\right)^{-1} \tag{15}$$

and for which "h" is the height of the substrate layer being evaluated for first-order filter characteristics, and may be equal to 0.51 mm, and "β" is the phase constant of a wave with wavelength λ (which in the dielectric substrate equal to $\lambda_0/\sqrt{\varepsilon_r}$) and equals 2π/λ. Using the equations above, the circuit parameters may be obtained using curve fitting technique. In one example, the values are determined to be $L_1$=1.6 nH, $L_2$=1.34 nH, $C_1$=17.98 fF, $C_2$=5.37 fF, $C_g$=2.03 fF.

Figure 16:
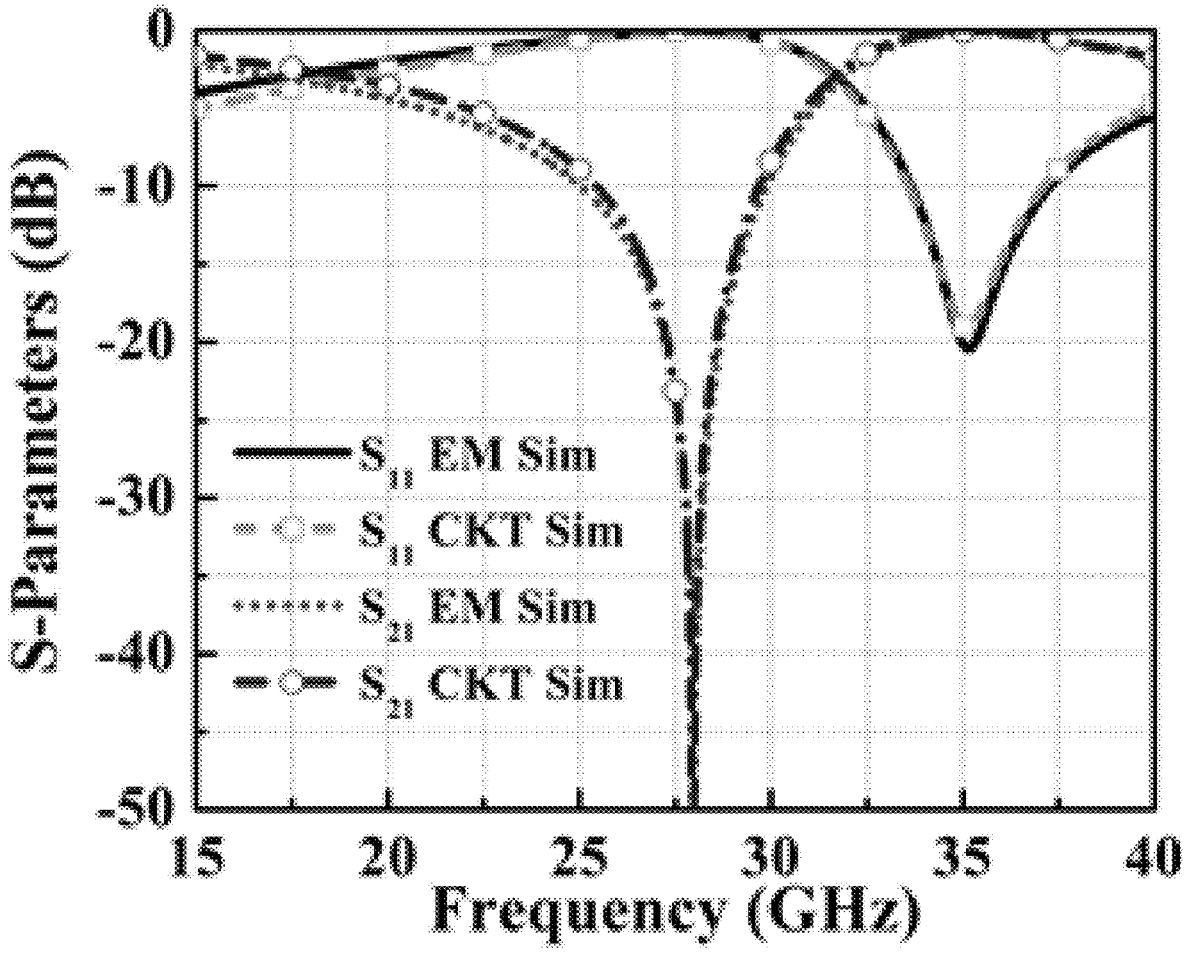
FIG. 16 is a graph showing simulated transmission characteristics of the portion of the first-order element of the FSS structure of FIG. 11.

Each first-order element unit cell of the FSS structure 1100 exhibits resonating characteristics with a transmission zero and transmission pole. Simulations of the example FSS structure of FIGS. 11-13, demonstrated that the transmission zero is at 28 GHz and that the transmission pole is at 35.2 GHz. Simulations of S-parameters of the first-order element are shown in FIG. 16. The simulations shown in FIG. 16 demonstrate that the stopband extends from 25.025-29.875 GHz (characterized by $S_{21}$ being less than −15 dB), corresponding to an FBW of 17.677%, and that the passband extends from 33.64-37.288 GHz (characterized by $S_{11}$ being less than −10 dB), corresponding to an FBW of 10.29%.

Figure 17A:
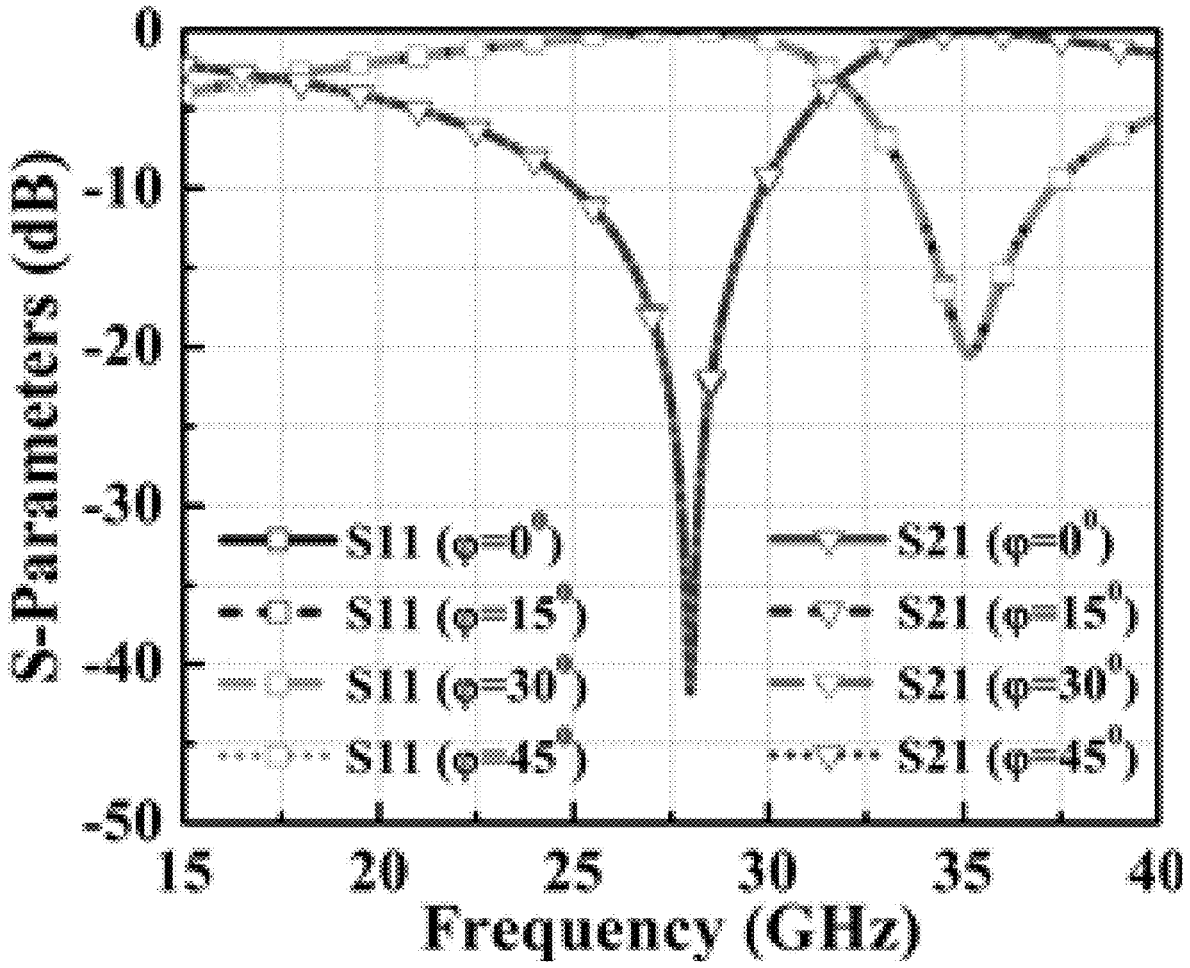
FIGS. 17*a* and 17*b* are graphs showing simulated reflection and transmission characteristics of the portion of the first-order element of the FSS structure of FIG. 11.
Figure 17B:
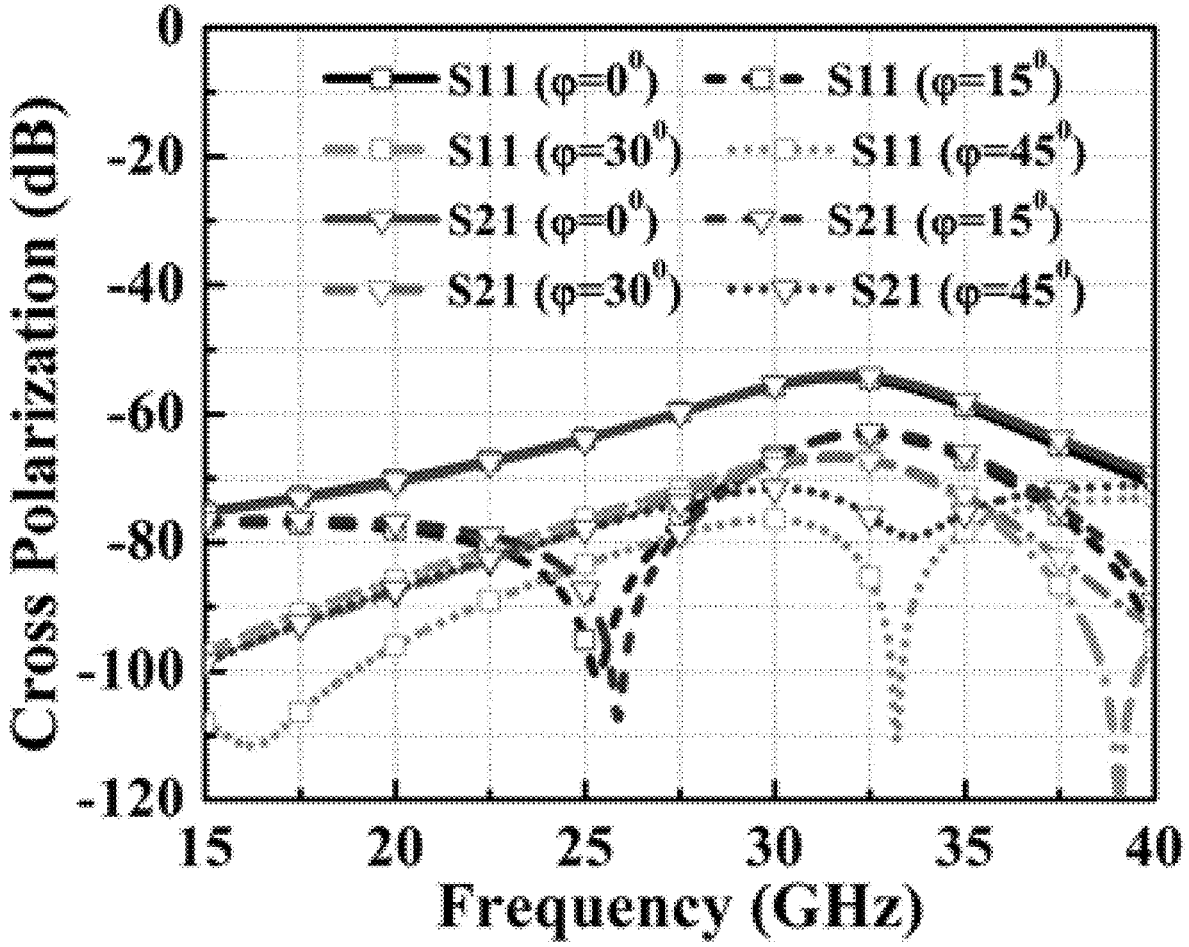

FIGS. 17*a* and 17*b* are graphs illustrating simulated reflection and transmission characteristics of the first-order element. FIG. 17*a* shows the co-polarized reflection and transmission coefficients for incident waves at different polarization angles ranging from 0° to 45°, and FIG. 17*b* shows the cross-polarized reflection and transmission coefficients for incident waves over the same range of polarization angles. It can be seen from FIG. 17*b* that the first-order element has low cross-polarized (XPol) components for both reflection and transmission coefficients. These components are below −54 dB over the entire frequency range (15-40 GHz is shown in FIG. 17*b*).

The looped cross of the first-order element has been demonstrated to exhibits a transmission zero at a relatively high frequency, and to behave as a capacitive loading at relatively lower frequencies of resonance. In the particular example of FIG. 12, simulations of the looped cross 1220 demonstrated a transmission zero at a frequency of 58.3 GHz and added capacitive loading at frequencies below 58.3 GHz. The additional capacitive loading provided by the looped cross enables the overall size of the FSS unit cell to be reduced. Inclusion of the looped cross also decreases the quality factor of the FSS structure, which in turn increases the bandwidth at the stopband resonance.

Figure 18:
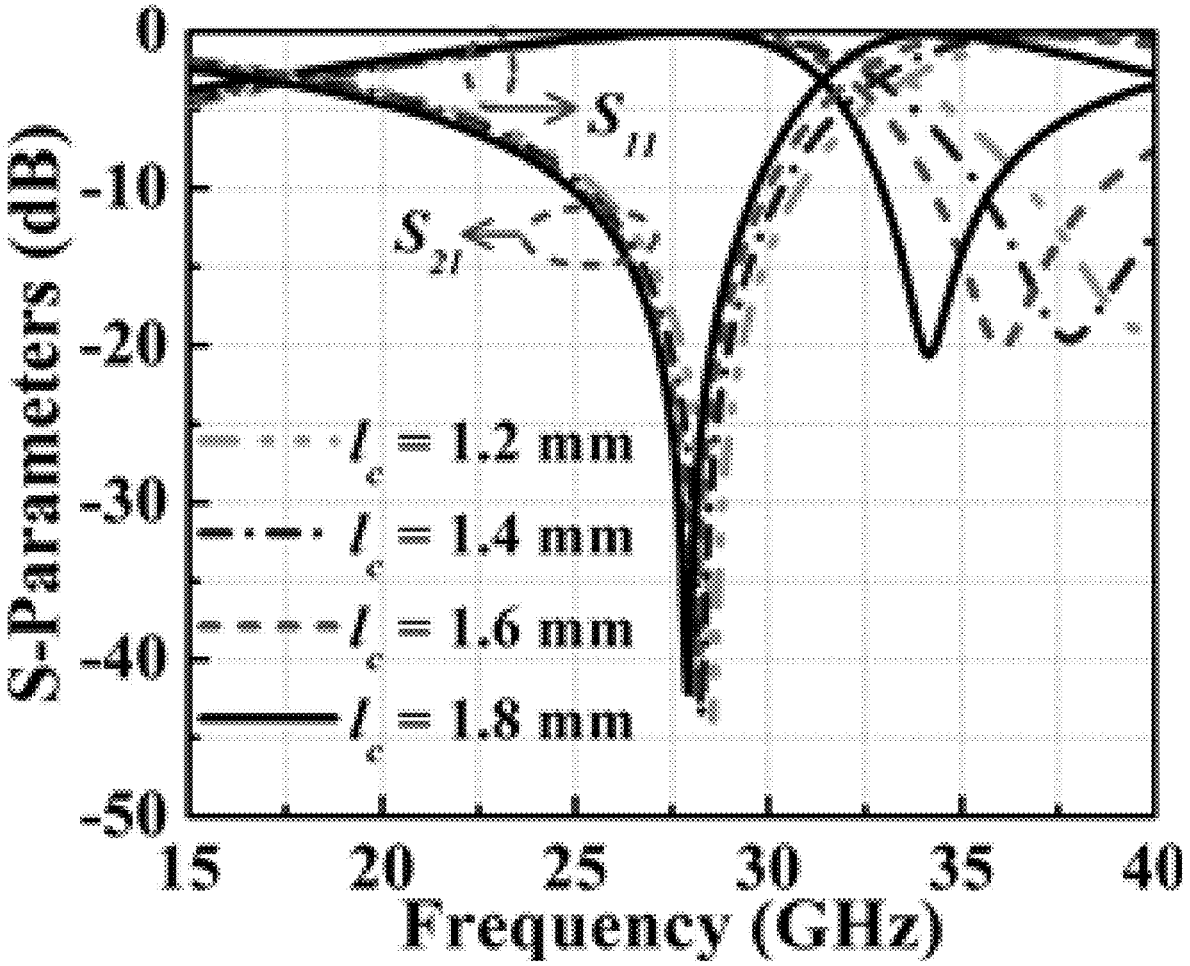
FIG. 18 is a graph showing simulated transmission characteristics of the portion of the first-order element of the FSS structure of FIG. 11 as a function of looped cross length.

The looped cross also has a predetermined length, which is defined as $l_c$ in FIG. 12. A desired value for length $l_c$ may be calculated based on simulations. FIG. 18 is a graph illustrating simulated S-parameters of the first-order element as a function of the value of $l_c$. As can be seen from FIG. 18, increasing $l_c$ results in a downward shift of the transmission pole from a relatively higher to a relatively lower frequency, while the effect on the transmission zero is negligible. Additionally, as can be seen from FIG. 18, increasing $l_c$ also results in an increase to the quality factor of the passband. Thus, a length of $l_c$ may be chosen according to yield a desired passband frequency and passband frequency range of a first-order FSS structure.

Figure 19:
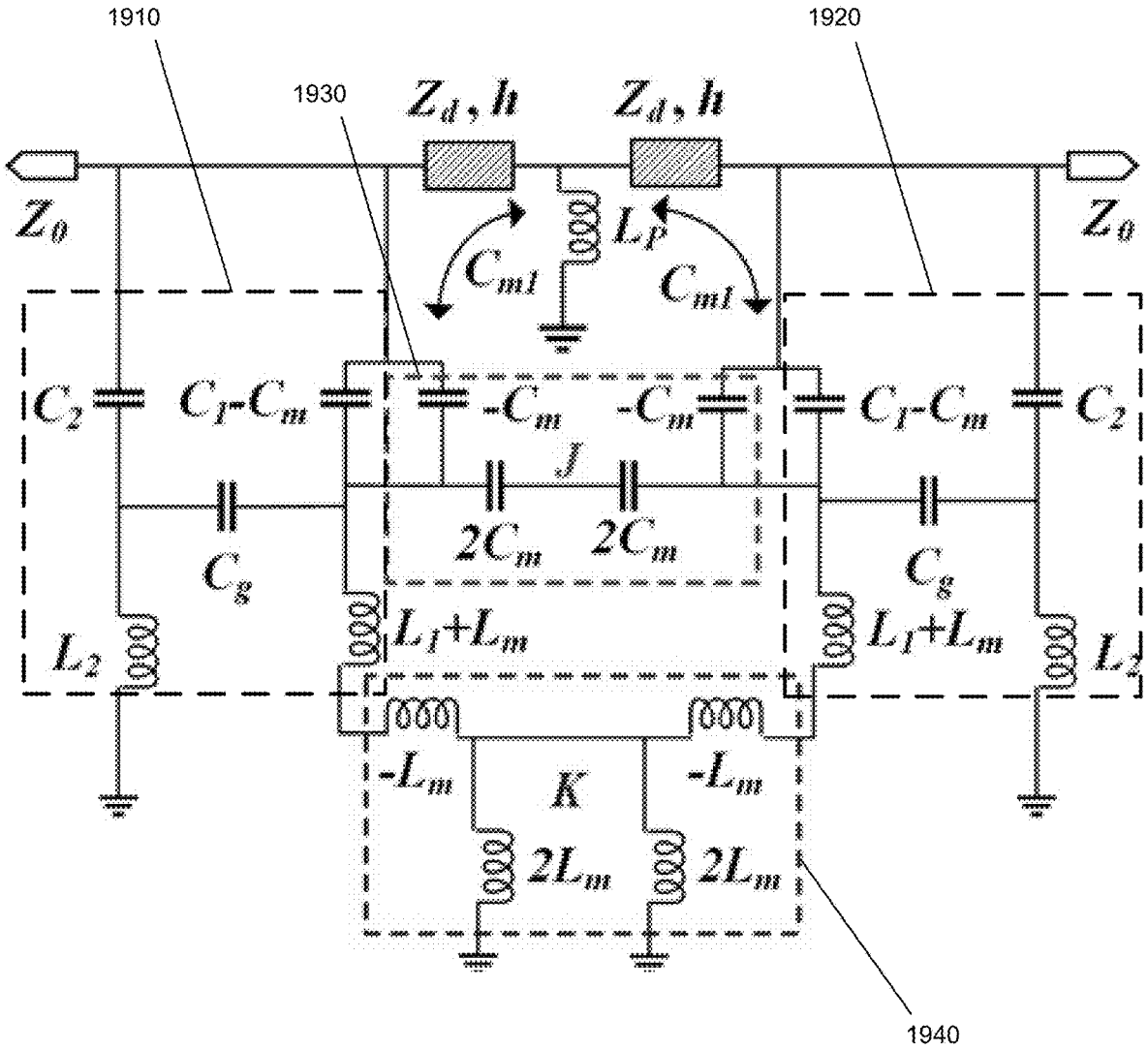
FIG. 19 is a circuit diagram showing an equivalent circuit of the FSS structure of FIG. 11.

FIG. 19 is a circuit diagram showing an equivalent circuit 1900 of the FSS structure 1100, which exhibits both a first-order and a second-order filtering response. The equivalent circuits of the respective first-order elements are shown as boxes 1910 and 1920, respectively. The electric coupling path between the spiral resonators of boxes 1910 and 1920 is shown as admittance inverter J in box 1930, and the magnetic coupling path between the spiral resonators of boxes 1910 and 1920 is shown as impedance inverter K in box 1940. Lastly, mutual coupling between the spiral resonators and the looped crosses due to fringing of the electric field between the overlapping area of boxes 1910 and 1920 is shown as a mutual coupling capacitance $C_{m1}$. Lastly, the mesh grid in the second metal layer is represented as inductance $L_P$.

Figure 20A:
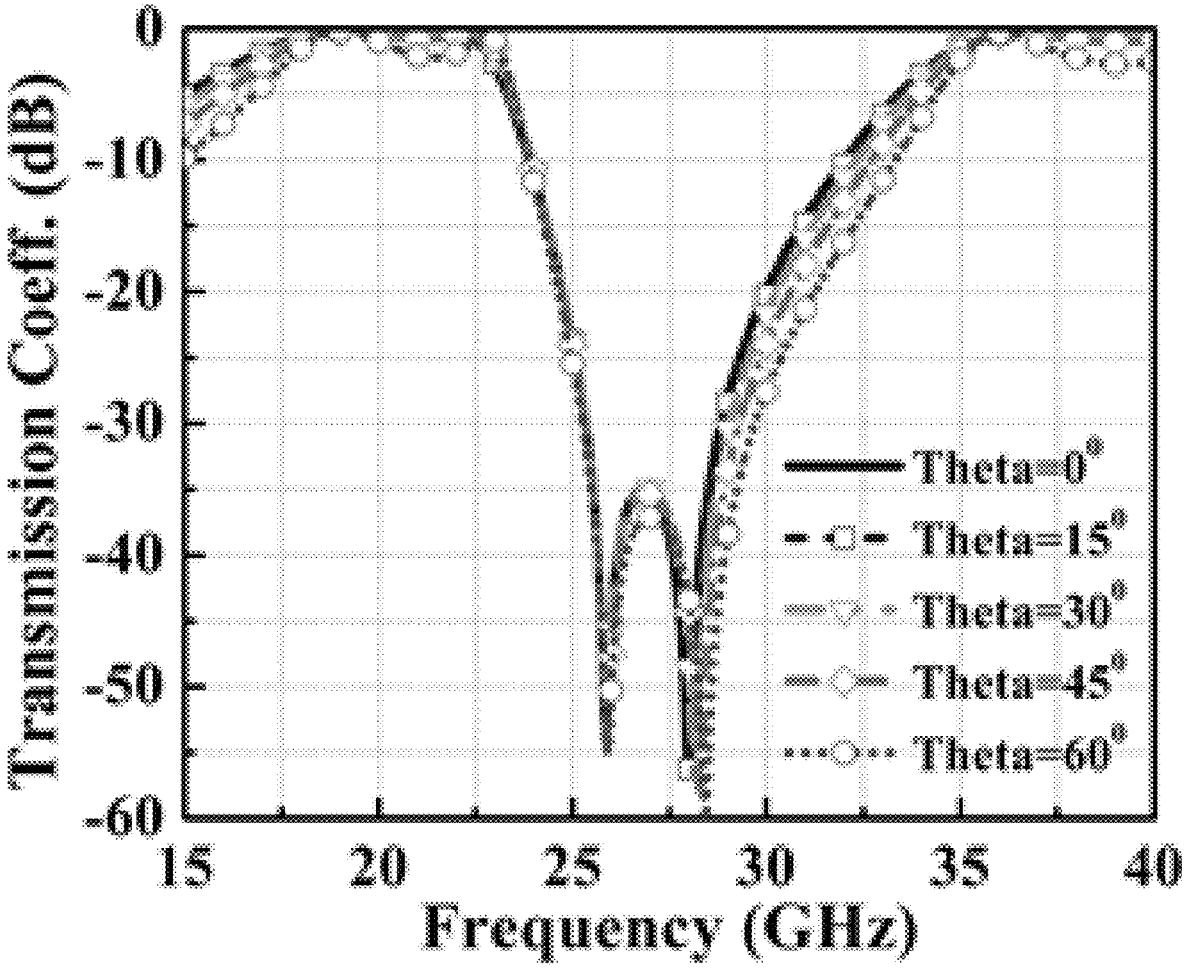
FIGS. 20*a* and 20*b* are graphs showing simulated reflection and transmission characteristics of a second-order element of the FSS structure of FIG. 11.
Figure 20B:
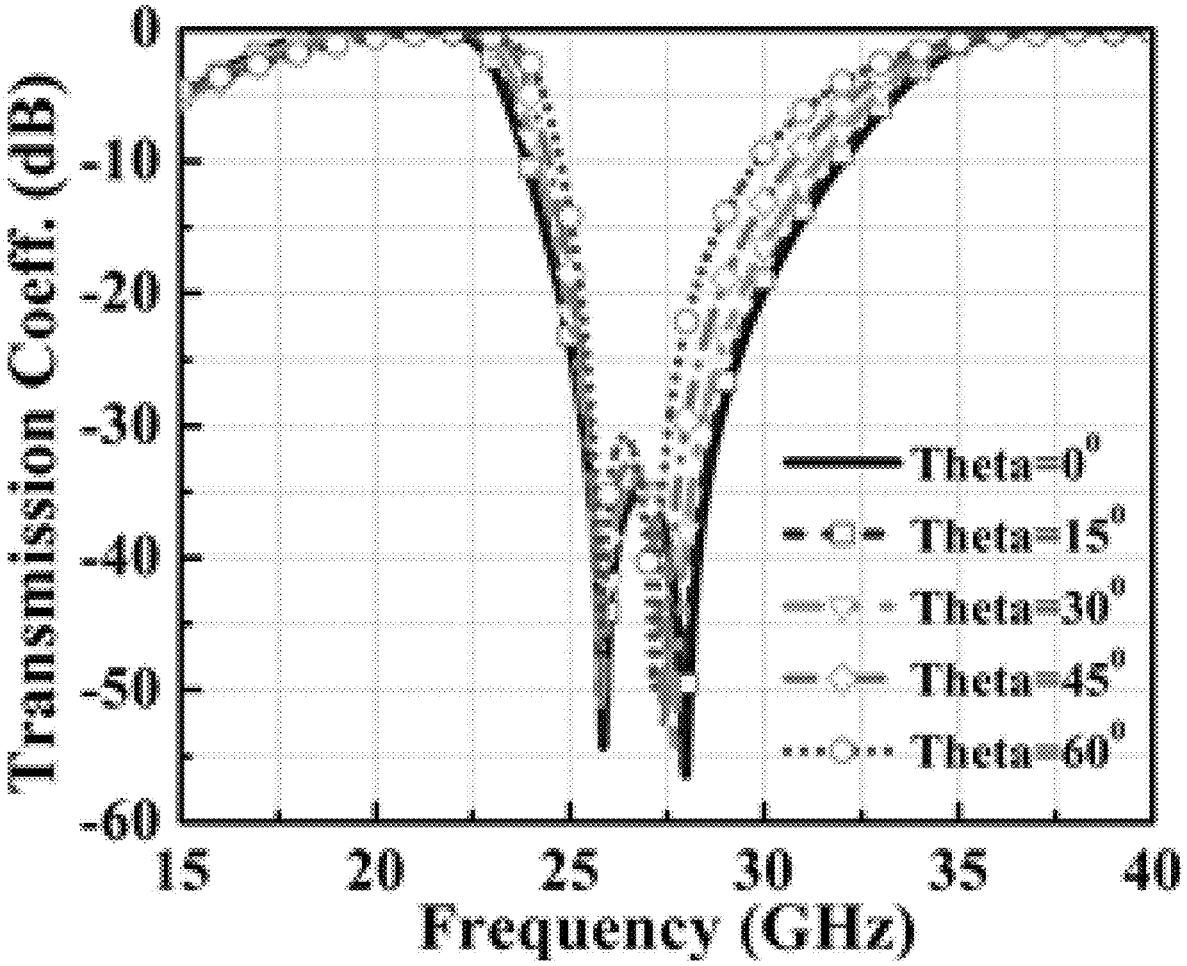

FIGS. 20*a* and 20*b* are graphs illustrating simulated reflection and transmission characteristics of the second-order element. FIG. 20*a* shows the co-polarized reflection and transmission coefficients for incident waves at different polarization angles ranging from 0° to 60°, and FIG. 20*b* shows the cross-polarized reflection and transmission coefficients for incident waves over the same range of polarization angles. It can be seen from FIGS. 20*a* and 20*b* that stable resonance characteristics are exhibited even with higher oblique incident angles. For instance, a shift in resonant frequency is within 1.57% for TE modes of polarization with an incident angle up to 60°, and a shift in resonant frequency is within 3% for TM modes of polarization with an incident angle of up to 60°.

Figure 21:
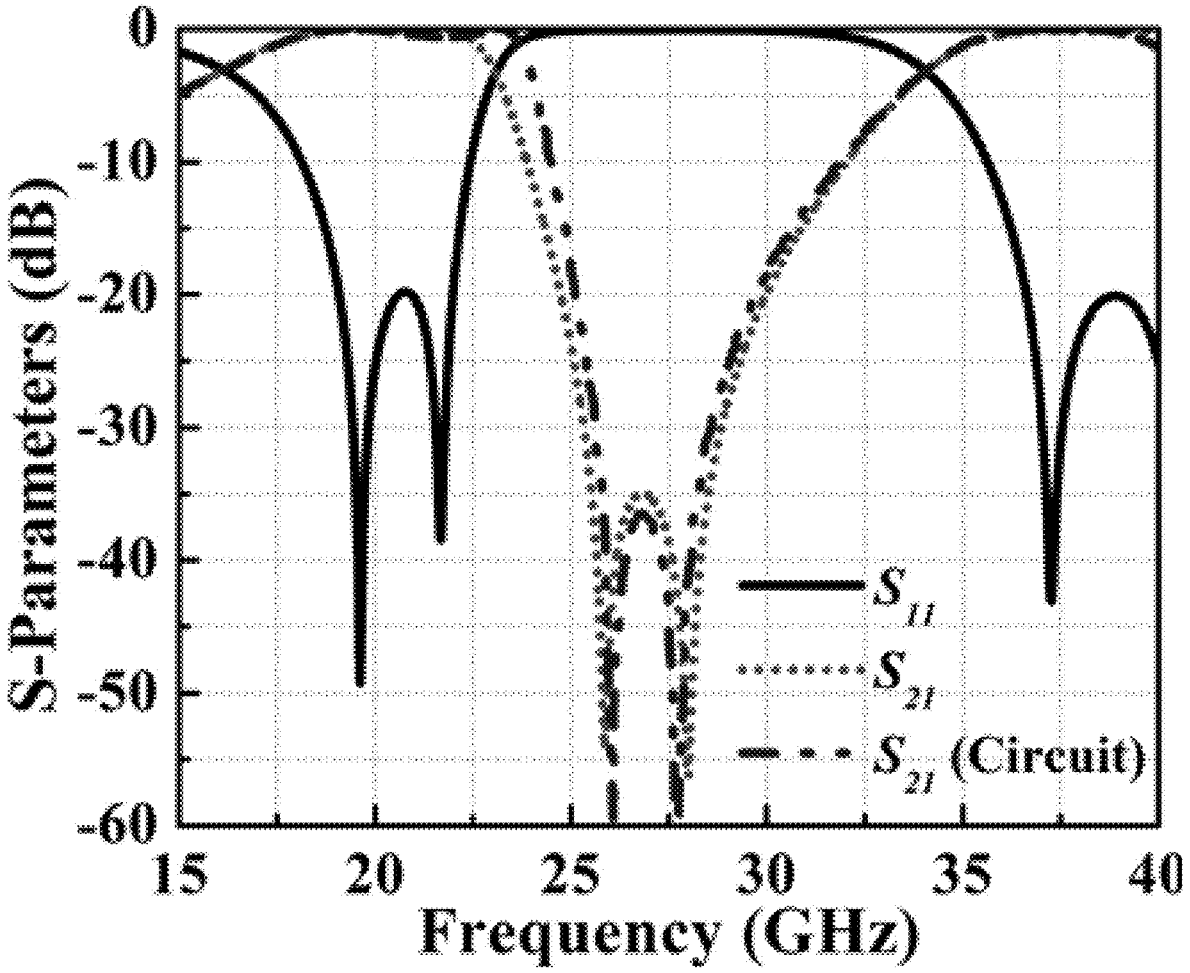
FIG. 21 is a graph showing simulated transmission characteristics of the second-order element of the FSS structure of FIG. 11.

FIG. 21 is a graph illustrating simulated S-parameters of the second-order element. FIG. 21 shows a second order passband resonance for which $S_{11}$<−10 dB extending between 18.134-22.441 GHz (an FBW of 21.23%) with transmission poles located at 19.62 GHz and 21.68 GHz. FIG. 21 also shows a second-order stopband for which $S_{21}$<−15 dB extending between 24.34-30.89 GHz (an FBW of 23.72%) with transmission zeros located at 25.86 GHz and 27.98 GHz.

Figure 22A:
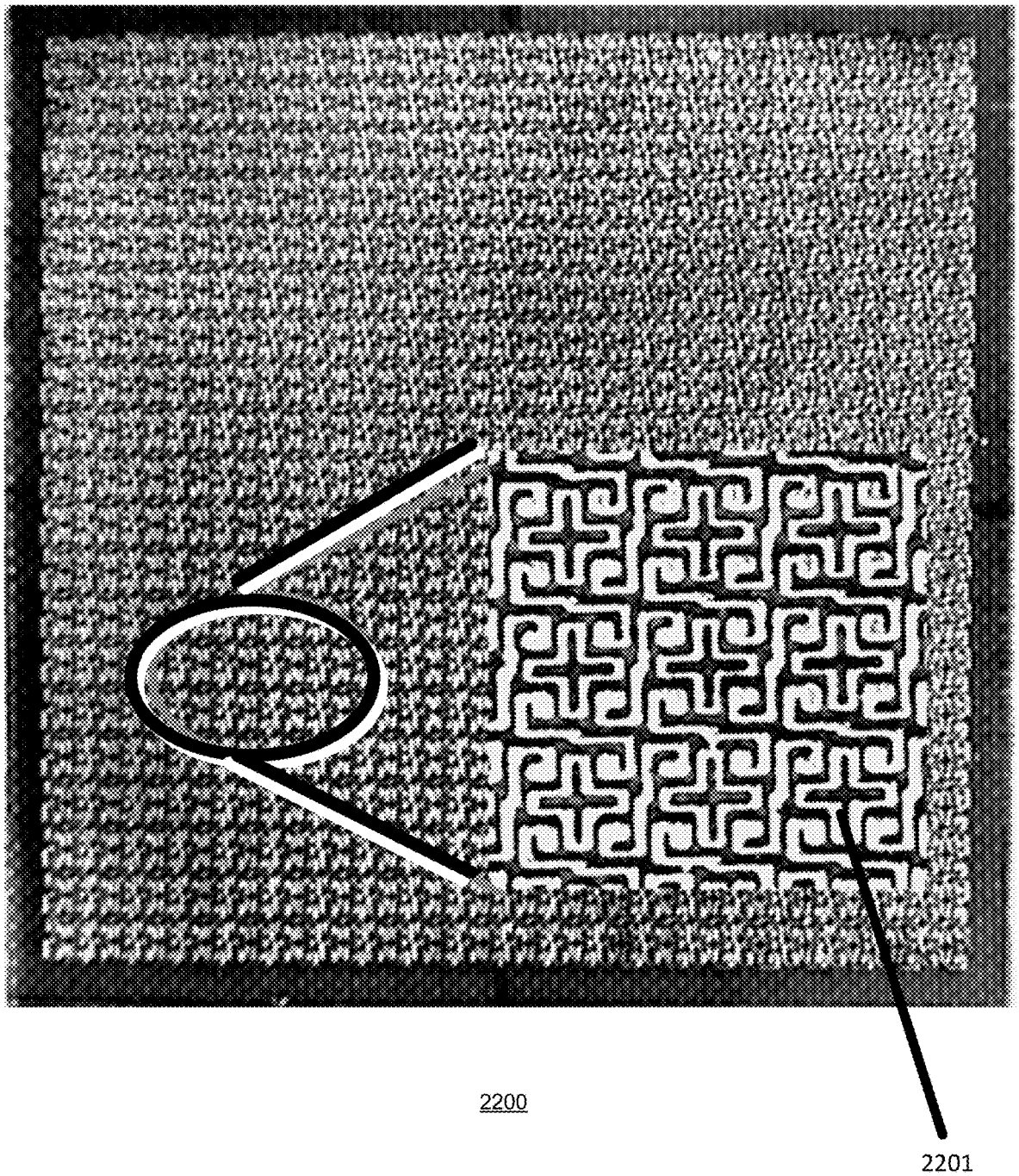
FIGS. 22*a* and 22*b* are top views of a top layer and a middle layer, respectively, of a prototype FSS in accordance with an aspect of the present disclosure.
Figure 22B:
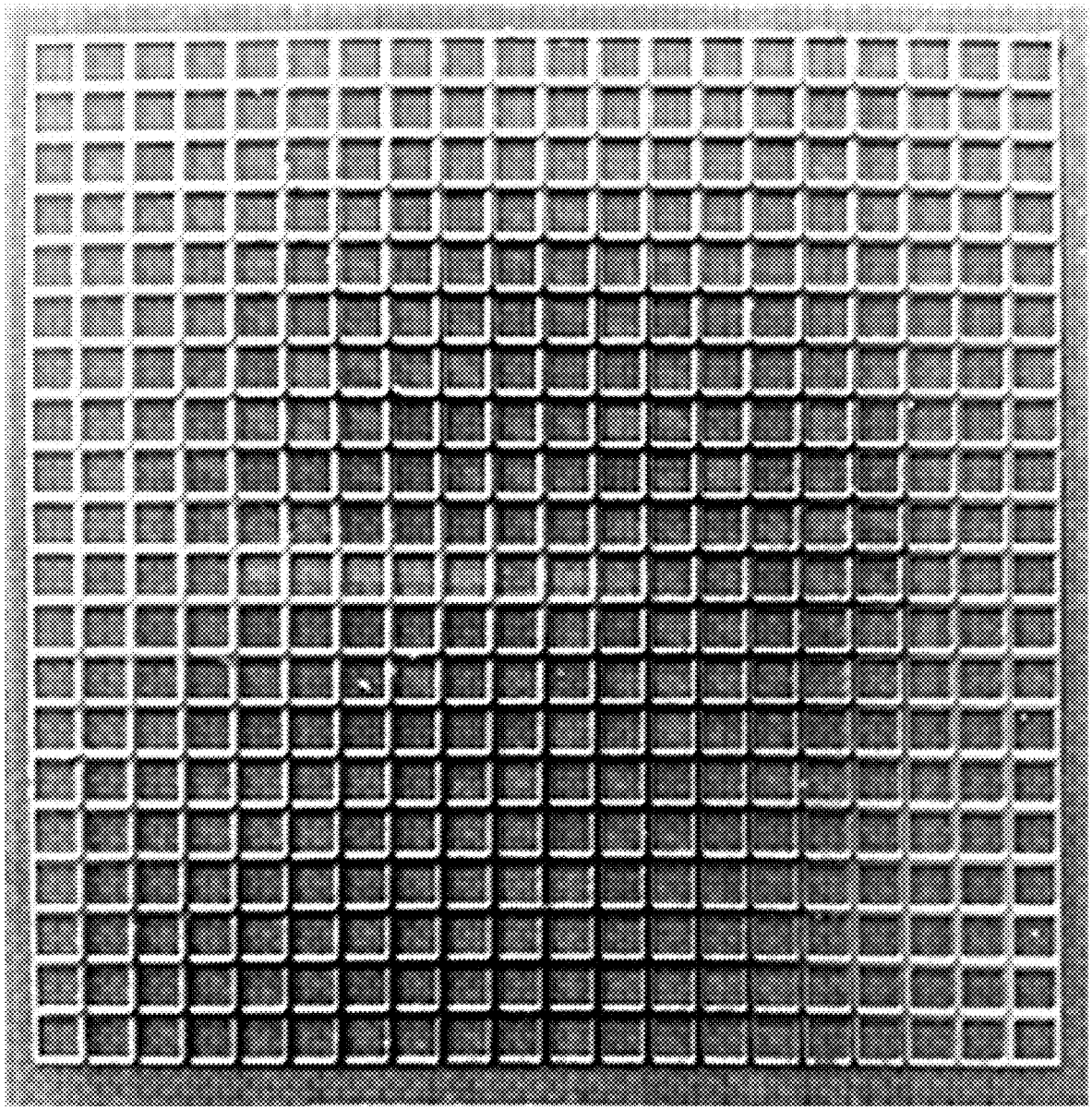

In order to conduct measurements of the FSS structure 1100, a prototype was developed. FIGS. 22*a* and 22*b* show respective components of the developed prototype 2200. FIG. 22*a* shows the top and bottom metal layers, each including a 20×20 array of FSS structure unit cells 2201, each unit cell patterned according to a common pattern, which in the case of FIG. 22*a* is the pattern shown in FIG. 12. FIG. 22*b* shows the mesh grid of the second or middle metal layer.

Figure 23A:
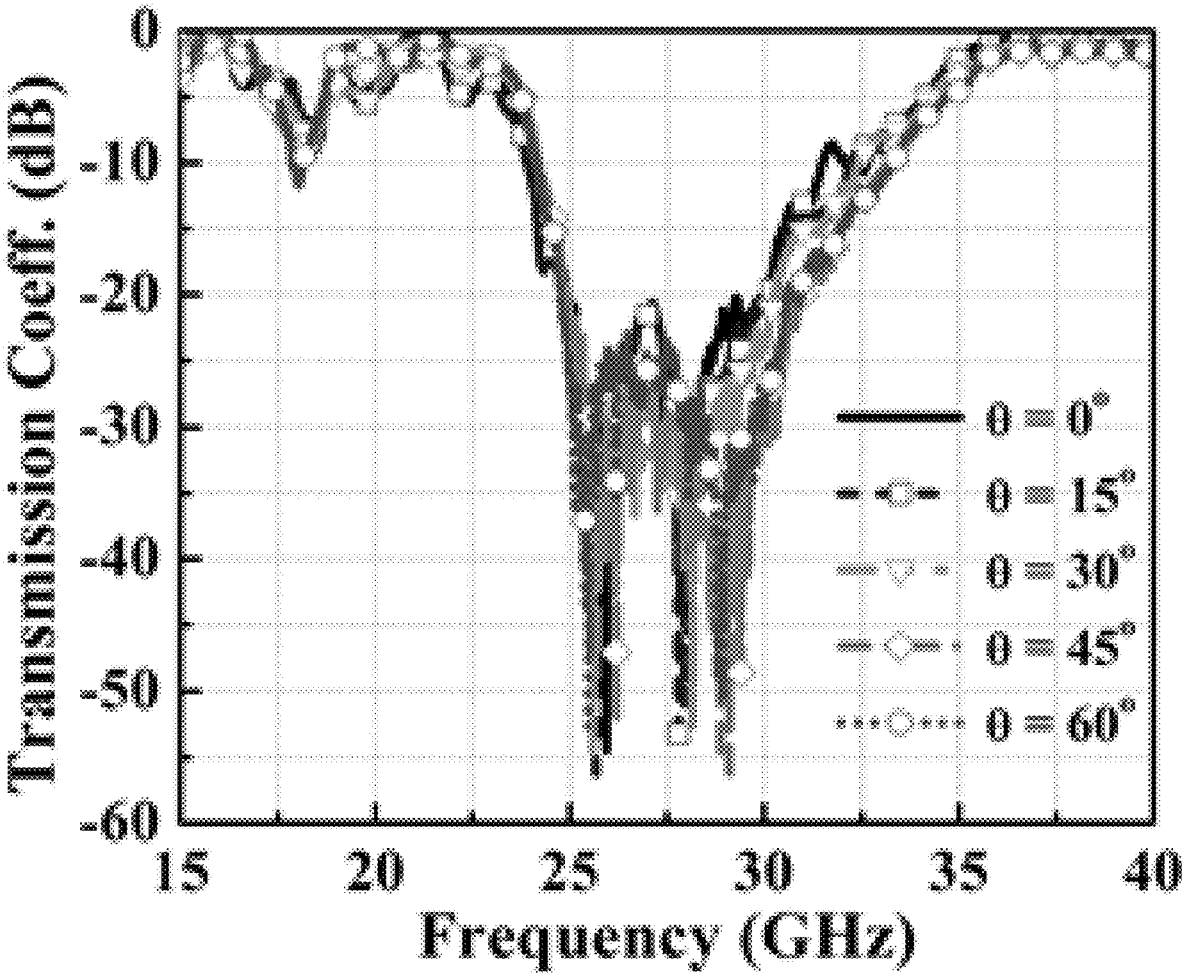
FIGS. 23*a* and 23*b* are graphs showing reflection and transmission characteristics of the prototype FSS of FIGS. 22*a* and 22*b*.
Figure 23B:
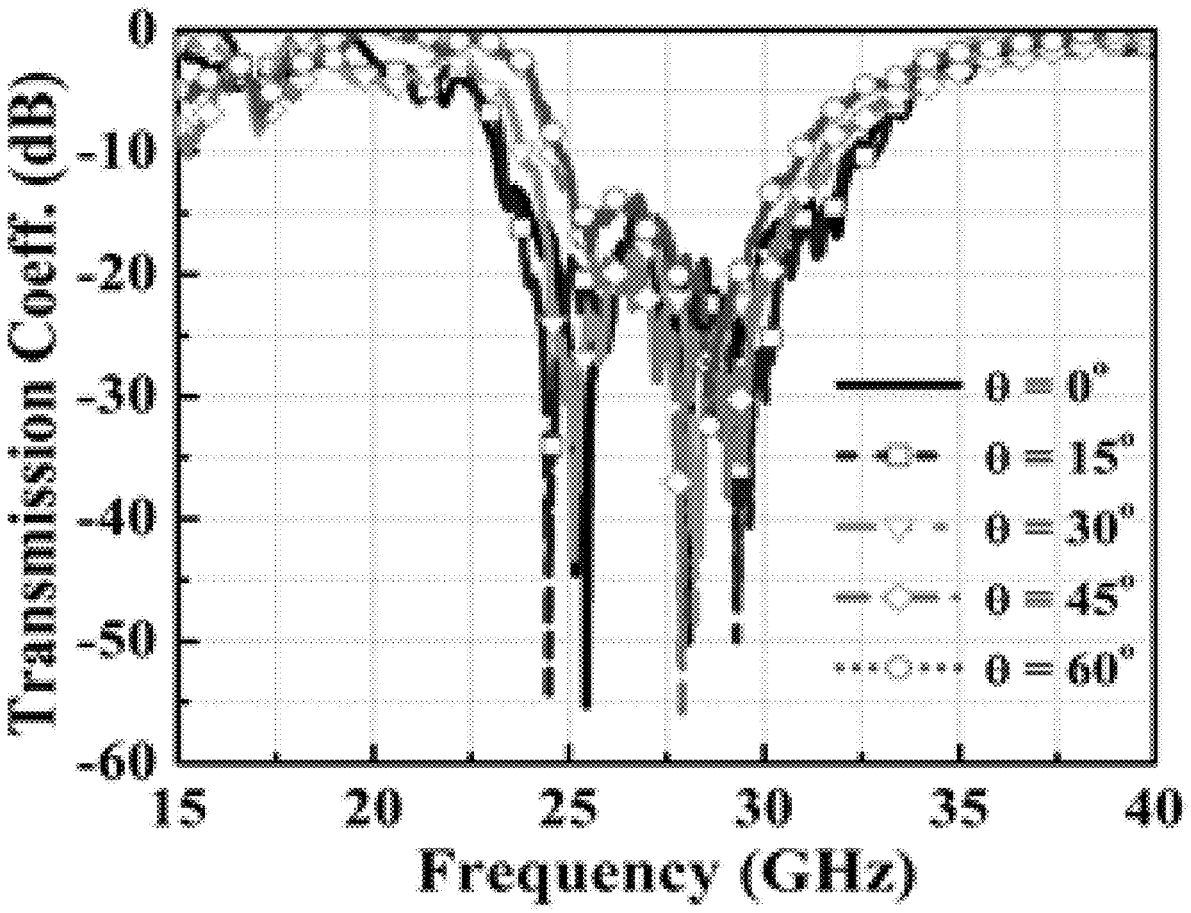

FIGS. 23*a* and 23*b* are graphs illustrating measured transmission characteristics of the prototype FSS structure 2200 for TE and TM waves, respectively. Transmission coefficients were measured for incident waves at different polarization angles ranging from 0° to 60°. It can be seen from both FIGS. 23*a* and 23*b* that the prototype FSS structure. As shown in FIG. 23*a*, shifts in frequency for the prototype FSS structure are limited within 2.99% for TE modes of polarization with an incident angle up to 60°, and a shift in resonant frequency is within 1.96% for TM modes of polarization with an incident angle of up to 60°.

Figure 24A:
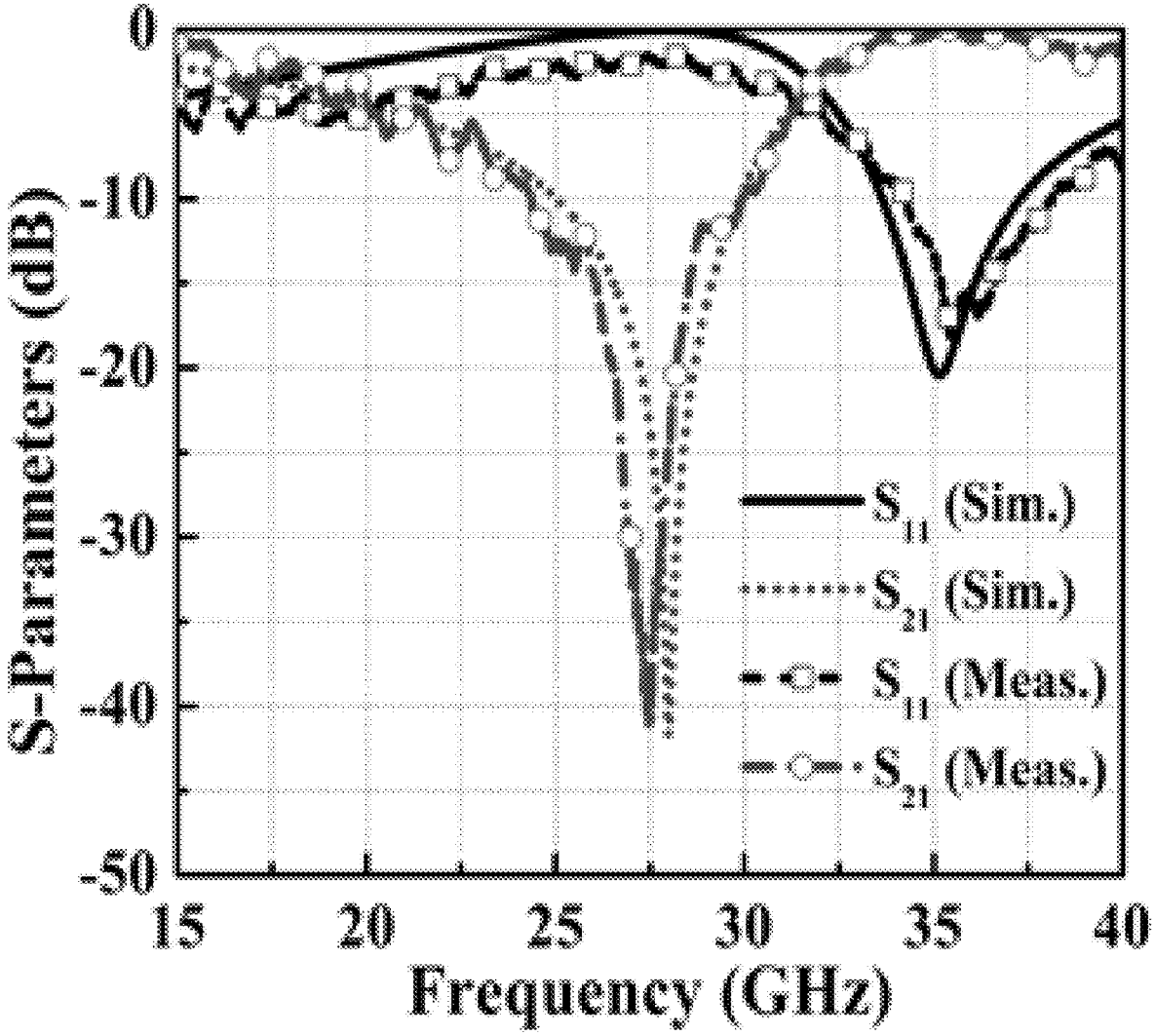
FIGS. 24*a* and 24*b* are graphs showing simulated transmission characteristics of the prototype FSS of FIGS. 22*a* and 22*b*.
Figure 24B:
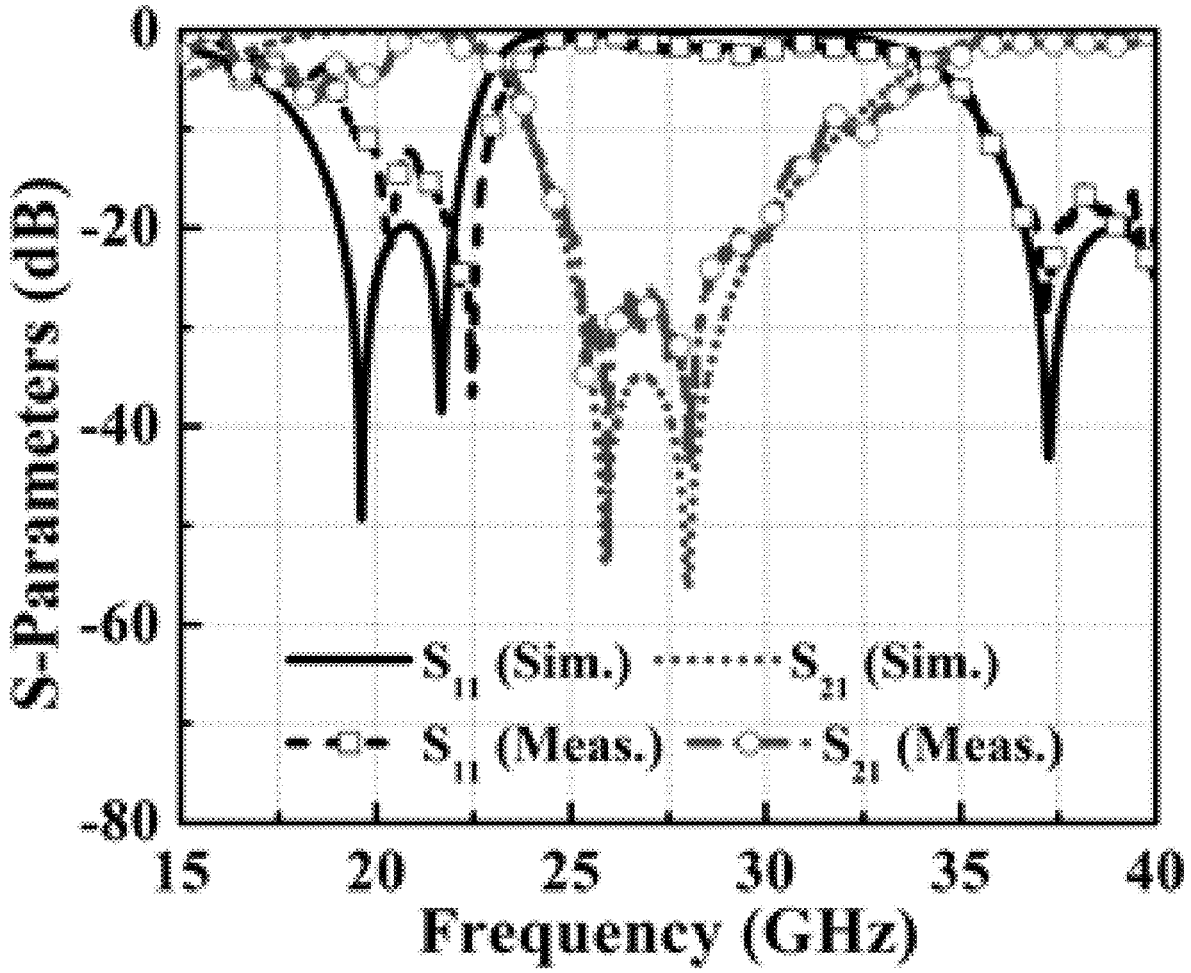

FIG. 24*a* is a graph illustrating measured S-parameters exhibited by the first-order filter response of the prototype FSS structure 2200. FIG. 24*b* illustrates the measured S-parameters exhibited by the second-order filter response of the prototype FSS structure 2200. It can be seen from FIGS. 24*a* and 24*b* that the measured response is largely comparable to the simulation results shown in FIG. 21. In particular, the prototype FSS structure exhibits first-order stopband characteristics for which $S_{21}$<−15 dB across a frequency range between 26.08-28.54 GHz (an FBW of 9.01%) and first-order passband characteristics for which $S_{11}$<−10 dB across a frequency range between 34.24-38.11 GHz (an FBW of 10.69%). A second-order response of the prototype FSS structure shows a passband for which $S_{11}$<−10 dB between 19.41-22.98 GHz (an FBW of 16.84%) and a stopband for which $S_{21}$<−15 dB between 24.33-30.49 GHz (an FBW of 22.47%). Transmission poles are located at 20.3 GHz and at 22.52 GHz and transmission zeros are located at 25.96 GHz and at 28.03 GHz.

A geometry of the example FSS structure 1100 of FIGS. 11-13 may be further modified in order to change transmission characteristics of the structure. For instance, a 2×2 block of the repeating unit cells of the structure may be modified along adjacent sides within the 2×2 block but not on the other sides in order to create a quad-element unit cell (QE-UC). By nature of the modifications, the periodicity Pc of the QE-UC-based FSS is 0.4140 for an operating frequency of 28 GHz.

Figure 25:
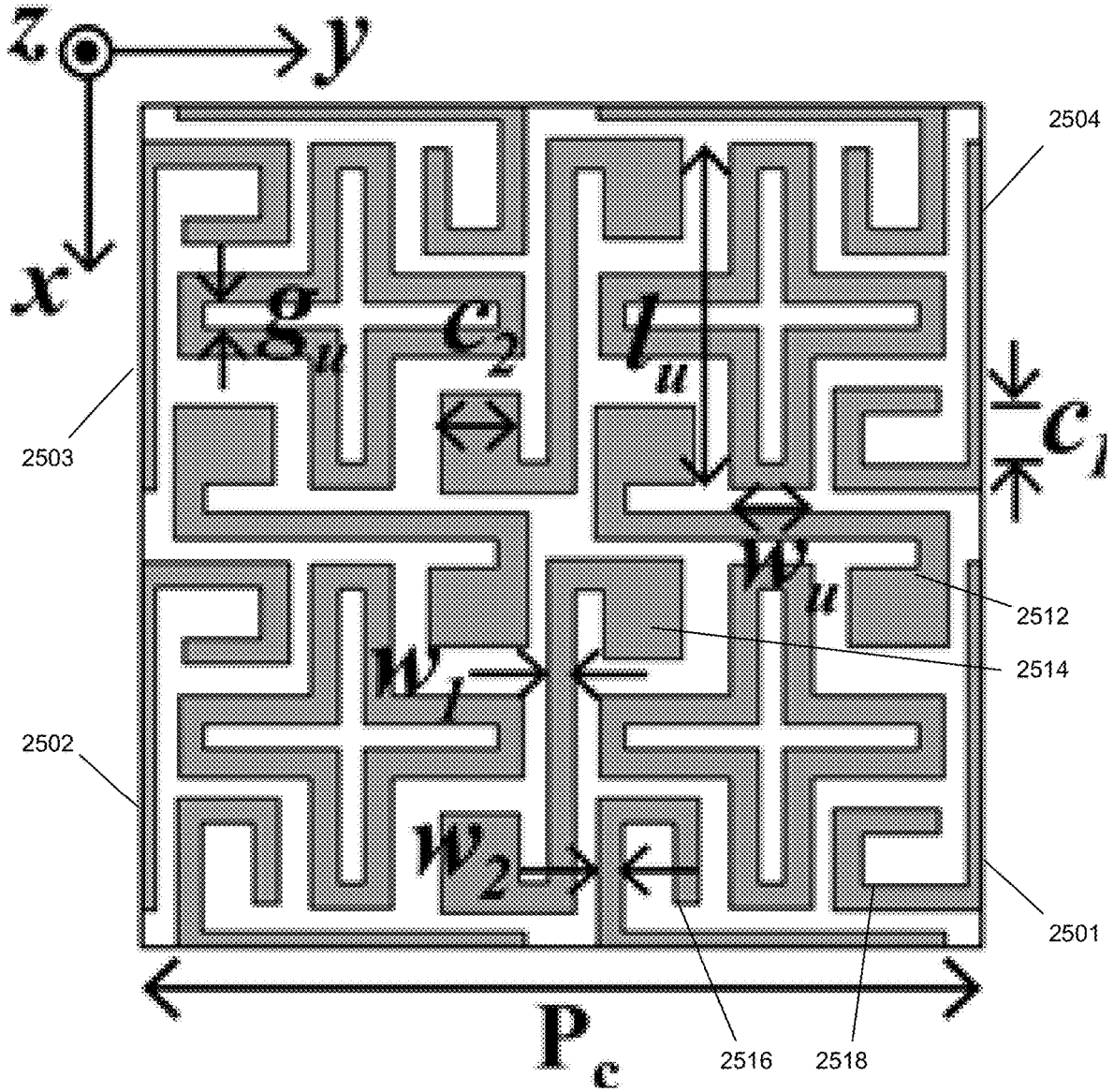
FIG. 25 is a top view of an alternative example unit cell of the example FSS structure of FIG. 11.

FIG. 25 shows an example of a QE-UC pattern 2500. The pattern is comparable to the pattern shown in FIG. 12, except that for each given quadrant 2501-2504 of the QE-UC, the number of segments and widths of the segments of the spiral resonators 2512, 2514 adjacent to the other quadrants differ from the number of segments and widths of the segments of the spiral resonators 2516, 2518 that are not adjacent to the other quadrants of the QE-UC. This results in formation of two different types of spiral resonator formed within the FSS structure according to an alternating pattern. In the particular example of FIG. 25, one type spiral resonator (e.g., resonators 2512, 2514) includes three segments and the segment closest to the center 2525 of the quadrant is relatively wide, and the other type of spiral resonator (e.g., resonators 2516, 2518) includes four segments and the segment closest to the center of the quadrant is relatively narrow. Additional dimensions of the QE-UD pattern not discussed in connection with FIG. 12 include a modified width of a space in the spiral resonators $c_1$, and widths of the various segments of the spiral elements $w_1$, $w_2$ and $c_2$.

The QE-UC pattern 2500 of FIG. 25 exhibits a highly selective passband at a frequency of 28 GHz. Due to the alternating types of spiral resonators including in the FSS structure, the QE-UD exhibits a pair of transmission zeros near the skirts of the lower and higher sidebands.

Figure 26:
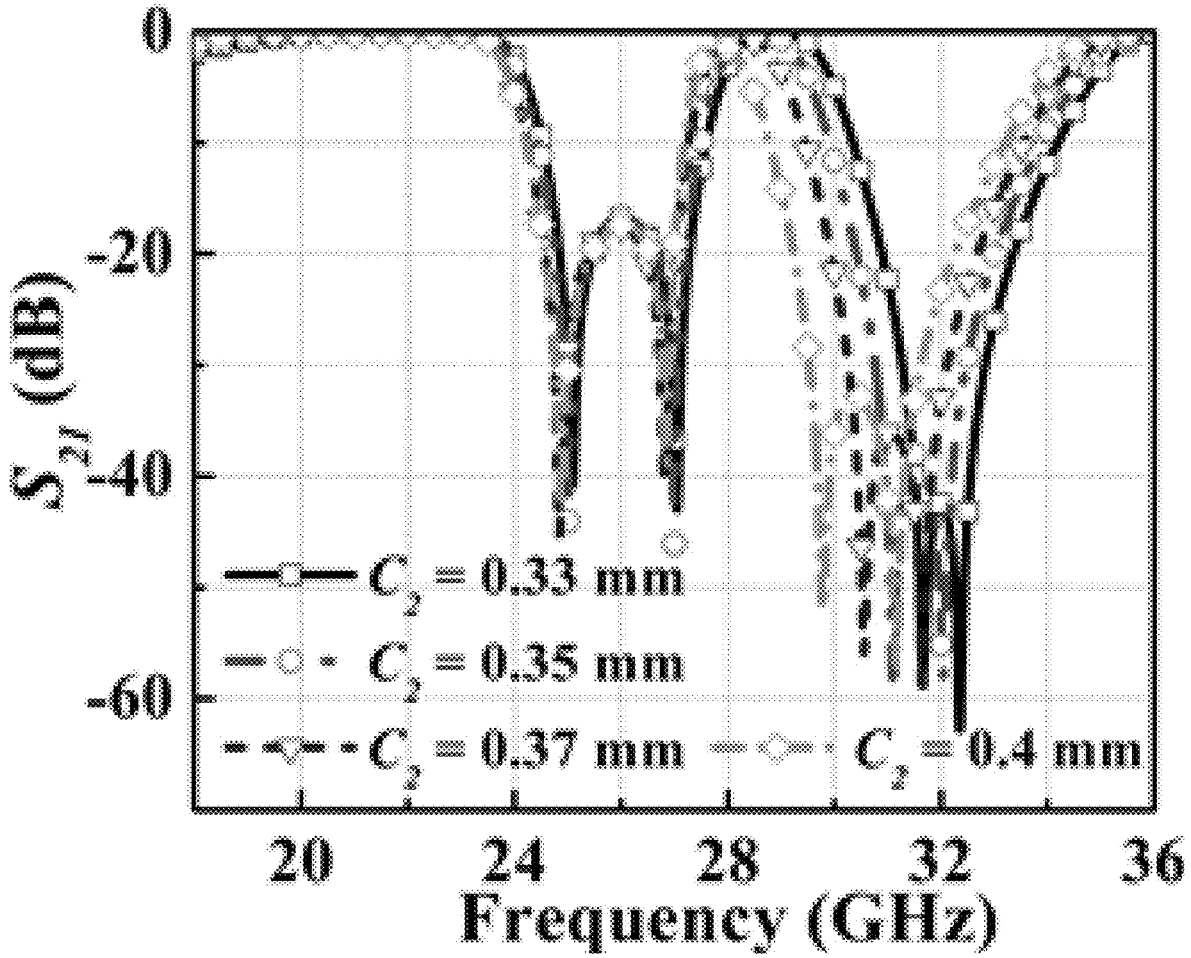
FIG. 26 is a graph showing transmission characteristics of an FSS structure with the unit cell of FIG. 25.

FIG. 26 is a graph showing simulations of an FSS with the QE-UC pattern. The simulation demonstrates formation of a passband at or around 28 GHz, which is particularly useful for 5G applications. Additionally, upper and lower sidebands are accompanied by second-order bandstop characteristics. The appearance of transmission zeros near to the sidebands allows for high passband selectivity. In the particular example of the QE-UC pattern of FIG. 25, FIG. 26 shows first-order bandstop characteristics extending between 24.6-26.15 GHz for the lower sideband (an FBW of 6.11%) with a transmission zero located at 25.8 GHz, and between 29.51-32.32 GHz for the upper sideband (an FBW of 9.09%) with a transmission zero located at 31.05 GHz, and a frequency ratio of 1.2. Second-order bandstop characteristics of the QE-UC show an FBW of 11.46% for the lower band (24.27-27.22 GHz) with a pair of transmission zeros at 24.9 GHz and 26.85 GHz, and an FBW of 13.77% for the higher band (29.07-33.37 GHz) with a pair of transmission zeros at 30.15 GHz and 31.35 GHz. The 3 dB transmission BW is 3.64%.

Figure 27:
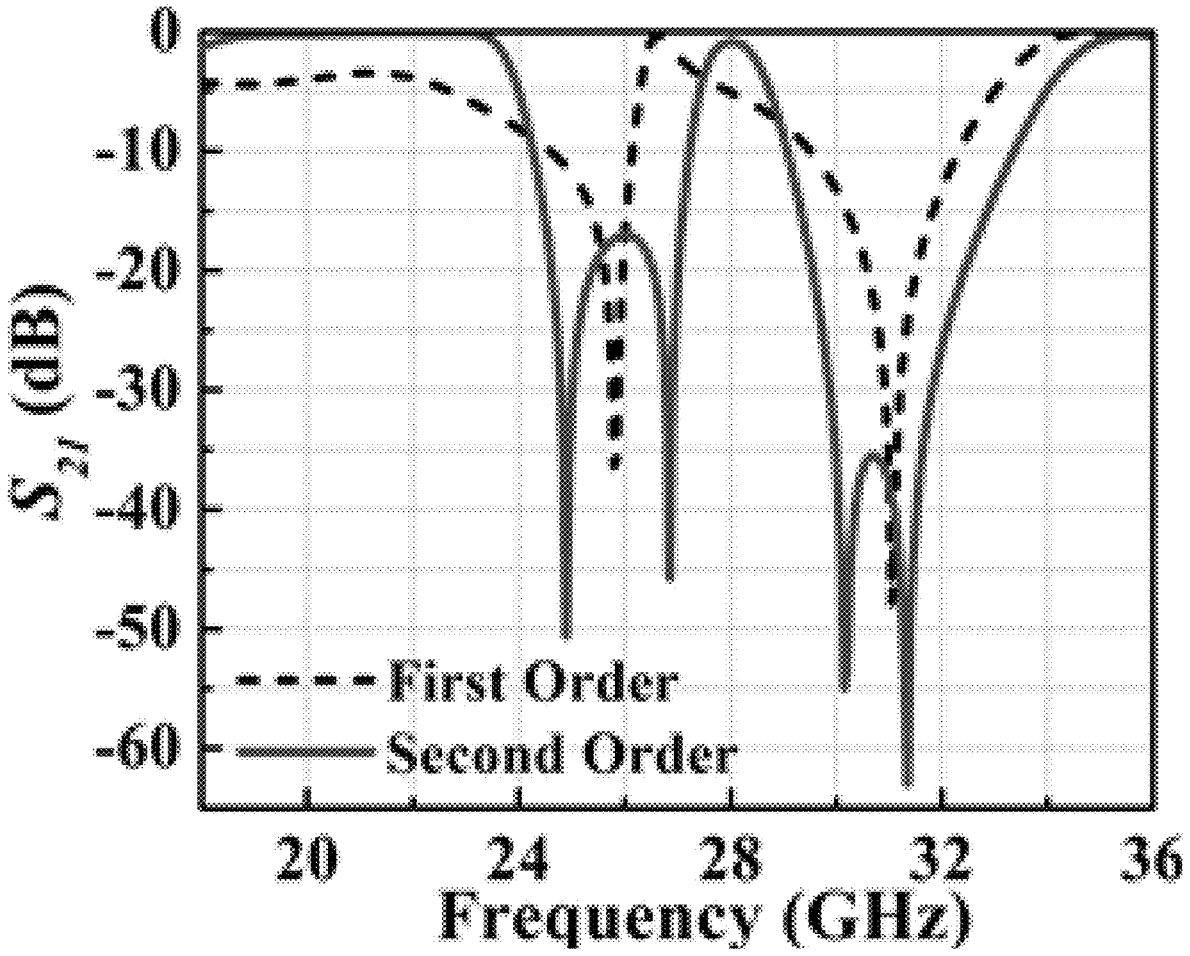
FIG. 27 is a graph showing transmission characteristics of an FSS structure with the unit cell of FIG. 25 as a function of resonator width.

Simulations of the QE-UC-based FSS structure also show that increasing the width $C_2$ of the segment closest to the QE-UC center in the modified spiral resonator (e.g., 2512, 2514) can result in a downward shift to the transmission zeros of the higher stopband due to an increase in capacitance attributable to the looped cross. For instance, this can be seen in the graph of FIG. 27, illustrating changes in $S_{21}$ as the value of $C_2$ is modified. It is further observed in FIG. 27 that the change to the upper stopband occurs without any significant change to the lower stopband. This demonstrates that independent tuning of frequency bands is possible with the QE-UC-based FSS design of FIG. 25.

Overall, the FSS structures of FIGS. 11-13 and 25 demonstrate that reflection bands with a sharp roll off at the band edges is possible without sacrificing low profile of the FSS. Additionally, the proposed FSS patterns are advantageous as they provide low insertion loss (e.g., less than 0.73 dB) within the transmission band and high reflection magnitude of 0.96 within the stopband resonance. These characteristics make the example FSS structures advantageous for providing a stable filter response with higher incident angles and over broad changes in polarization.

As discussed herein, the above example structures were tested using a number of techniques, including simulation of models and measurement of prototypes. Concerning simulation, either or both of circuit simulations and EM full-wave simulations may be performed in order to derive accurate projections of the FSS structure's properties and behaviors. For instance, an FSS can be designed in Ansys HFSS or a similar program, and can be modelled using quasi static analysis. Boundary conditions may be assigned in the plane of the FSS along both the X and Y axis directions in order to replicate an infinite array. Additionally, floquet ports may be assigned in the Z axis direction normal to the wave propagation direction. Concerning measurements, the tested prototype arrays were 20 units by 20 units for each FSS made using standard monolithic microwave integrated circuit (MMIC) fabrication techniques. Filtering characteristics of the prototypes are tested using a free space measurement technique. As seen from the graphs herein, the measured results were found to be in generally good agreement with the full-wave and circuit simulated results.

Common miniaturization techniques used to fabricate the unit cells may include lumped reactive component loading, convoluted geometry, and via loaded 2.5D geometry. Convoluted geometry, in particular, is advantageous in that it possess a completely planar geometry.

Ultimately, an FSS designed according to the unit cells disclosed herein are capable of achieving multiple transmission poles and zeros with high angular stability (stable characteristics for an oblique incident angle as high as 60°) and polarization insensitivity. This can be used for wireless and satellite communication (SATCOM) in various capacities. For instance, the example FSS of FIG. 1 can be used to provide passbands that cover the uplink frequencies for Ku band SATCOM (14-14.5 GHz) and the uplink frequencies for Ka band SATCOM (27.5-31 GHz), as well as a stopband that covers the down-link frequency range for Ka band (17.7-21.2 GHz). For example, the example FSS of FIG. 1 can also be used for millimeter wave 5G communication at 28 GHz as antenna reflector, beam shaping, radomes and absorber. For further instance, the example FSS of FIG. 11 can be used to provide passbands that cover the down-link frequency range of Ka band SATCOM as well as to provide a wide second-order stopband resonance that covers the uplink frequency of Ka band. The FSS of both examples can further be used as EM shielding and utilized in other spatial filtering applications for both Ku band and Ka band in different capacities.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A frequency selective surface (FSS) comprising:
- a plurality of unit cells arranged in an array, wherein each unit cell includes:
  - a first dielectric substrate; and
  - a first metal layer formed on a top surface of the at least one dielectric substrate, wherein the first metal layer includes:
    - a first pattern element positioned at a center of the unit cell and configured to produce a first transmission pole at a first frequency; and
    - a second pattern element positioned around a border of the unit cell and configured to produce a second transmission pole at a second frequency different from the first frequency, wherein the second pattern elements of the plurality of unit cells collectively form a grid pattern, wherein the first pattern element is further configured to produce a transmission zero between the first frequency and the second frequency.

2. The FSS of claim 1, wherein the first pattern element is a modified Jerusalem cross, wherein the modified Jerusalem cross exhibits a capacitance that is greater than a capacitance of a standard Jerusalem cross.

3. The FSS of claim 2, wherein the modified Jerusalem cross includes:
- a cross potent; and
- a numeral 7 attached to a midpoint of each free end of the cross potent.

4. The FSS of claim 2, wherein the modified Jerusalem cross includes:
- a first ring element including breaks at each corner of the first ring element;
- a cross element formed inside the first ring element;

a second ring element formed outside of and concentric to the first ring element, and including breaks at each corner and at a midpoint of each side of the second ring element; and a plurality of connecting elements, each connecting element diagonally connecting corresponding broken corners of the first and second ring elements.

5. The FSS of claim 4, wherein a center frequency of the transmission zero shifts less than 0.3% for electromagnetic waves at incident angles between 0-60°.

6. The FSS of claim 5, wherein respective center frequencies of the transmission poles shift about 2% or less for TE mode electromagnetic waves at incident angles between 0-60°, and about 3% or less for TM mode electromagnetic waves at incident angles between 0-60°.

7. The FSS of claim 1, wherein the first pattern element has 90° rotational symmetry.

8. The FSS of claim 1, wherein the first frequency is an uplink frequency within the Ku band, and wherein the second frequency is an uplink frequency within the Ka band, and wherein the transmission zero is within a down-link frequency range for Ka band.

9. The FSS of claim 8, wherein a first passband around the first transmission pole has a fractional bandwidth of about 8% for which return loss is less than −10 dB, a second passband around the second transmission pole has a fractional bandwidth of about 11% for which return loss is less than −10 dB, and a stopband around the transmission zero has a fractional bandwidth of about 12% for which insertion loss is less than −15 dB.

10. The FSS of claim 1, wherein each unit cell has a length and width between one eighth and one quarter of an operational wavelength of the FSS and a height between one fiftieth and one twentieth of the operational wavelength.

11. The FSS of claim 1, wherein the plurality of unit cells are arranged in a 20×20 array.

12. An electromagnetic shield including the FSS of claim 1, wherein the electromagnetic shield is configured to provide spatial filtering within at least one of Ku band or Ka band.

13. A device comprising the FSS of claim 1, wherein the device is configured to operate at an operational frequency of 28 GHz, and wherein the FSS is configured to function as at least one of an antenna reflector, a beam shaper, a radome, or a radiation absorber.

14. A frequency selective surface (FSS) comprising:

a plurality of unit cells arranged in an array, wherein each unit cell includes:

a bottom metal layer;

a first dielectric substrate formed on a top surface of the bottom metal layer;

a middle metal layer formed on a top surface of the first dielectric substrate;

a second dielectric substrate formed on a top surface of the middle metal layer; and a top metal layer formed on a top surface of the second dielectric substrate, wherein each of the bottom and top metal layers include a first pattern element positioned at a center of the unit cell; and a second pattern element positioned around a border of the unit cell, and wherein the middle metal layer includes a third pattern element, wherein the third pattern elements of the plurality of unit cells collectively form a grid pattern.

15. The FSS of claim 14, wherein the bottom metal layer and first dielectric substrate form a first filter element configured to produce a first-order filter response, wherein the second dielectric substrate and top metal layer form a second filter element configured to produce the first-order filter response, and wherein the first filter element, the middle metal layer and the second filter element collectively form a third filter element configured to produce a second-order filter response.

16. The FSS of claim 15, wherein the first-order filter response produces a stopband having insertion loss of less than −15 dB over a fractional bandwidth of between 15-20% and a passband having return loss of less than −10 dB over a fractional bandwidth of between 10-15%.

17. The FSS of claim 15, wherein the second-order filter response produces a stopband having insertion loss of less than −15 dB over a fractional bandwidth of between 20-25% and a passband having return loss of less than −10 dB over a fractional bandwidth of between 20-25%.

18. The FSS of claim 17, wherein the stopband covers at least a frequency range between 25-30 GHz, and wherein the passband covers at least a frequency range between 19-22 GHz.

19. The FSS of claim 17, wherein the second-order filter response produces two transmission poles within the passband, and two transmission zeros within the stopband.

20. The FSS of claim 19, wherein the passband covers a down-link frequency range within Ka band, and wherein the stopband covers an uplink frequency range within the Ka band.

21. The FSS of claim 14, wherein the first pattern element is a looped cross, and wherein the second pattern element is a plurality of spiral resonators positioned in respective quadrants of the unit cell.

22. The FSS of claim 21, wherein the looped cross has a predetermined length, and wherein the predetermined length of the looped cross is configured to control a center frequency of a transmission pole of the FSS independently of a center frequency of a transmission zero of the FSS.

23. The FSS of claim 21, wherein the looped cross is configured such that inclusion of the looped cross on each of each of the bottom and top metal layers results in an increase to a stopband bandwidth of the FSS.

24. The FSS of claim 14, wherein each of the first pattern element and the second pattern element has 90° rotational symmetry.

25. The FSS of claim 24, wherein resonant frequency shifts of the FSS are less than 3% for TE mode electromagnetic waves at incident angles between 0-60°, and less than 2% for TM mode electromagnetic waves at incident angles between 0-60°.

26. The FSS of claim 14, wherein each unit cell has a length and width between one eighth and one quarter of an operational wavelength of the FSS and a height between one twentieth and one tenth of the operational wavelength.

27. The FSS of claim 14, wherein the plurality of unit cells are arranged in a 20×20 array.

28. The FSS of claim 14, wherein the plurality of unit cells are quad-element unit cells (QE-UC) arranged in 2×2 blocks, wherein each QE-UC has 90° rotational symmetry, and wherein periodicity of the QE-UC is between one quarter and one half of an operating wavelength of the FSS.

29. The FSS of claim 28, wherein the first pattern element in each quadrant of the QE-UC is identical, and wherein the second pattern element in each quadrant of the QE-UC differs between second pattern elements between adjacent quadrants of the QE-UC and second pattern elements at borders between adjacent QE-UCs.

30. The FSS of claim 29, wherein adjusting a dimensional property of the second pattern elements between adjacent quadrants of the QE-UC results in a frequency shift to an upper stopband of the FSS independent of a frequency of a lower stopband of the FSS.

31. The FSS of claim 14, wherein the FSS is formed using monolithic microwave integrated circuit (MMIC) fabrication.

32. An electromagnetic shield including the FSS of claim 14, wherein the electromagnetic shield is configured to provide spatial filtering within at least one of Ku band or Ka band.

* * * * *